US005305666A

United States Patent [19]

LaTorre

[11] Patent Number: 5,305,666

[45] Date of Patent: Apr. 26, 1994

[54] INSTALLATION TOOL SYSTEM FOR HI-LOK-TYPE FASTENERS

[76] Inventor: Joseph S. LaTorre, 11632 Plantero Dr., Santa Ana, Calif. 92705

[21] Appl. No.: 856,839

[22] Filed: Mar. 23, 1992

Related U.S. Application Data

[63] Continuation of Ser. No. 500,197, Mar. 28, 1990, abandoned.

[51] Int. Cl.[5] ..... B25B 13/56

[52] U.S. Cl. ..... 81/55

[58] Field of Search ..... 81/55, 56

[56] References Cited

U.S. PATENT DOCUMENTS

| | | | |
|---|---|---|---|
| 3,247,741 | 4/1966 | Batten | 87/56 |
| 3,889,558 | 6/1975 | Duncan | 81/55 |
| 4,538,483 | 9/1985 | Batten | 81/56 |
| 4,617,844 | 10/1986 | Batten | 81/56 X |
| 4,721,022 | 1/1988 | Batten | 81/56 |
| 4,762,030 | 8/1988 | Nguyen | 81/55 |
| 4,836,062 | 6/1989 | LaTorre | 81/55 |
| 4,862,773 | 9/1989 | Batten | 81/55 |

*Primary Examiner*—James G. Smith
*Attorney, Agent, or Firm*—Albert L. Gabriel

[57] ABSTRACT

The invention is a tool for installing Hi-Lok-type fasteners consisting of a pin component having a headed end and a threaded end with a hex recess therein, and a collar component having a threaded body and a torque-off nut. The tool has a drive head in which a rotatably driven socket is supported for driving the collar component of the fastener during a fastener installation event. A tubular key holder is coaxial with the socket and rotationally fixed relative to the drive head, supporting a hex key against rotation in an axial keyway, the hex key being engageable in the pin component hex recess to hold the pin component against rotation during a fastener installation event. A retention shaft extends coaxially through the key holder, and its forward end is threadedly connected to the key to retain the key in the holder. The key is forwardly threadedly removable from the holder keyway by rotating the retention shaft in one direction relative to the holder, and another key is threadedly replaceable in the holder keyway by rotating the retention shaft in the other direction relative to the holder. Tooling inventory is minimized by the ability to utilize only a single size key for all socket lengths and drive hex recess sizes, and by the ability to utilize only eight holder sizes to accommodate the conventional eight socket lengths, for all socket hex recess sizes.

42 Claims, 18 Drawing Sheets

FIG. 2
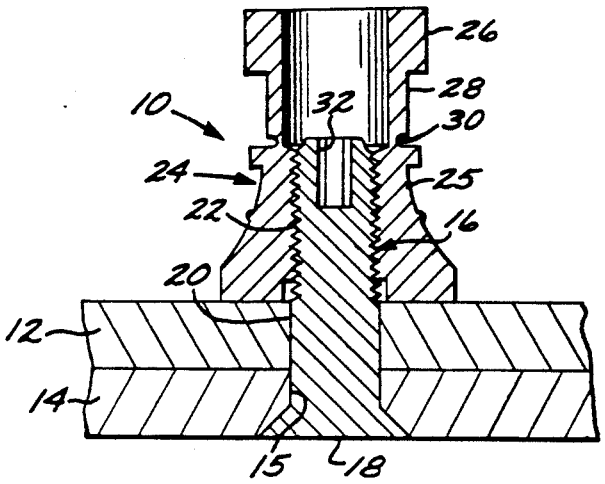
FIG. 1
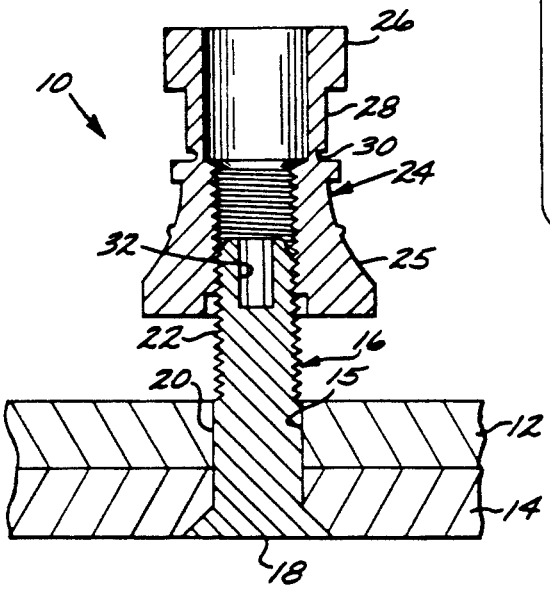
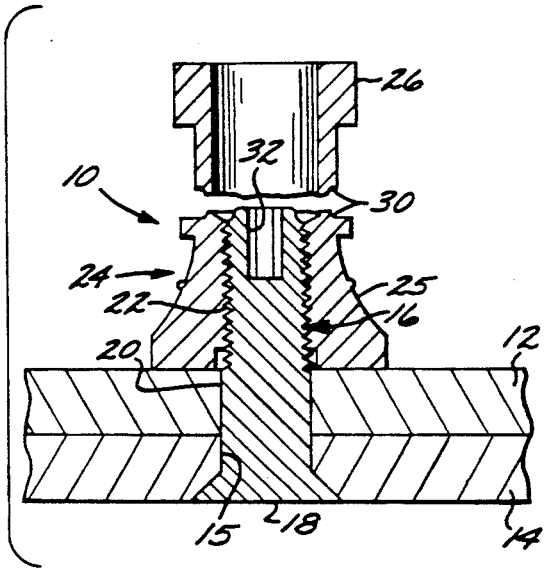
FIG. 3

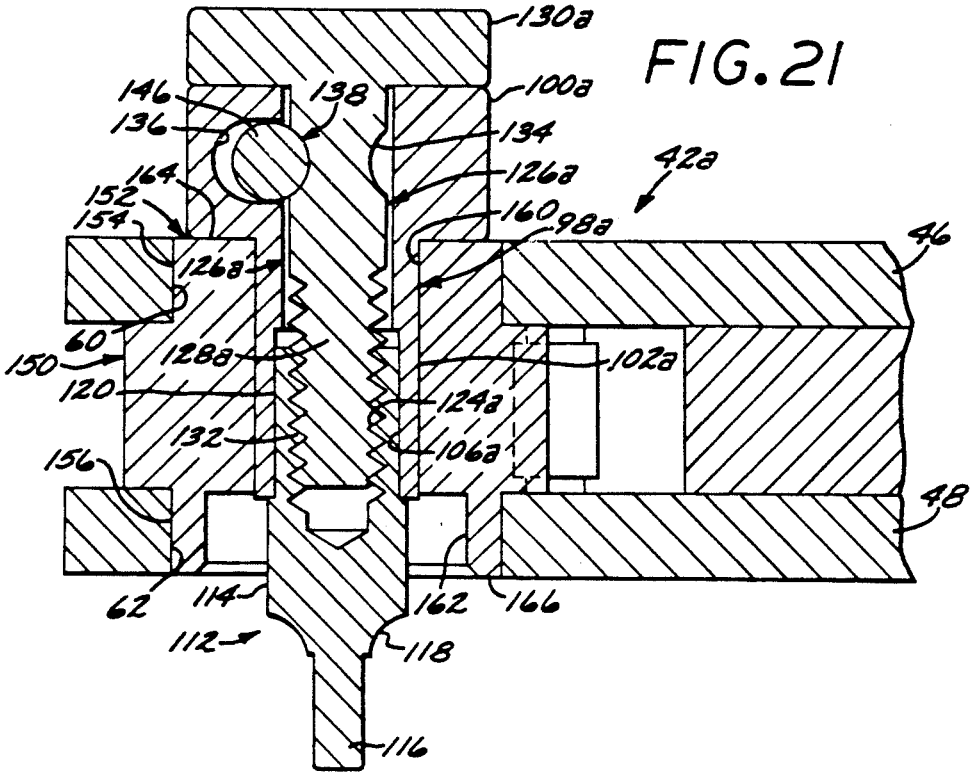
FIG. 21
FIG. 22
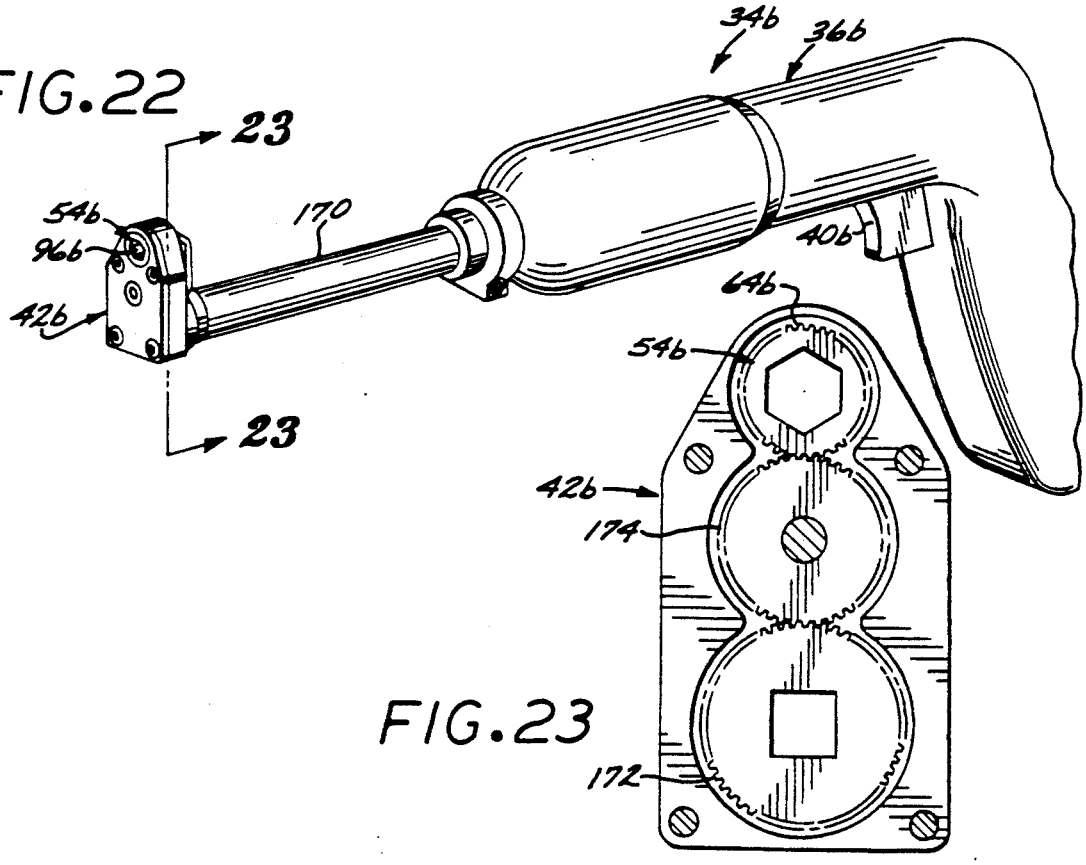
FIG. 23

INSTALLATION TOOL SYSTEM FOR HI-LOK-TYPE FASTENERS

This application is a continuation of application Ser. No. 07/500,197 filed Mar. 28, 1990, abandoned.

BACKGROUND OF THE INVENTION

1. Field of the Invention

The present invention is in the field of aerospace fastener installation tooling, and it relates particularly to such tooling which is adapted for installation of Hi-Lok-type frangible threaded fasteners.

2. Description of the Prior Art

Hi-Lok-type aerospace fasteners are currently in widespread use throughout the aerospace industry. This type of fastener was developed by Hi-Shear Corporation of Torrance, Calif., and is manufactured under a variety of names, including Hi-Lok, Hi-Tigue, Hi-Light, Very Light, and others. The Hi-Lok-type frangible fastener is particularly adapted for fastening two or more metal panels or workpieces together where there is only limited access for installation tooling, as for example, in the fastening together of wing spar members.

The Hi-Lok-type frangible fastener includes two basic components, a pin or bolt component which has a head end and a threaded end, and a collar component which has an internally threaded body portion and a torque-off drive nut portion. Generally, a series of regularly spaced holes is bored through the panels which are preclamped in their final assembly relative positions. One of the most important features of this fastener is that it enables the fasteners to be installed with the installation tooling disposed on one side only of the panel assembly. However, the Hi-Lok-type fastener is not a blind fastener.

The pin or bolt component is inserted from the rear (relative to the tooling) of the panel assembly, the body of the collar component of the fastener is then preliminarily threaded a few turns onto the exposed threaded end of the pin or bolt component on the operational side of the panel assembly, and then the tooling is applied over the collar component on the operational side. This tooling includes a rotary socket member which has a forwardly opening hex recess that engages the torque-off drive nut portion of the collar component, and also a rotationally stationary hex key which fits into a broached hex cavity in the threaded end portion of the pin or bolt component of the fastener. The socket member is rotated, usually by an air-powered motor in the tool body, and threadedly runs the collar component of the fastener down onto the pin or bolt component until a design preload on the panels is reached, while at the same time the pin or bolt component of the fastener is held against rotation by the rotationally stationary hex key. At the design preload, the drive nut portion of the collar component is automatically torqued off of the threaded body of the collar component, which then becomes the nut portion of the fastener. Thus, another important advantage of the Hi-Lok-type fastener is that the design preload is always automatically accurately achieved without the need for manual monitoring. Avoidance of over-torquing is thus also automatically achieved. The Hi-Lok-type fastener has other advantages, including sealing applications in "wet wing" structures, and good aerodynamic characteristics.

The basic Hi-Lok fastener is disclosed in U.S. Pat. No. 2,940,495, issued Jun. 14, 1960 to George S. Wing, and assigned to Hi-Shear Rivet Tool Company of Torrance, Calif. The only tooling that patent discloses is a conventional Allen wrench and a socket head. No power tooling is disclosed.

Applicant is aware of the following six U.S. patents which disclose tooling suitable for the installation of Hi-Lok-type frangible fasteners. These are Batten U.S. Pat. No. 4,538,483, Batten U.S. Pat. No. 4,617,844, Zils U.S. Pat. No. 4,462,281, Bochman, Jr. U.S. Pat. No. 3,027,789, Bosten U.S. Pat. No. 3,584,527, and Bangerter et al. U.S. Pat. No. 3,323,394. The two Batten patents disclose essentially the same tooling, with a minor modification in the later one. The two Batten patents are the only ones of which applicant is aware which disclose what purports to be a quick-release and replacement system for removal of a damaged or broken hex key and replacement thereof in the ratchet drive head assembly of the tool. However, there are numerous problems associated with this key release and replacement system, which is a ball detent type of system, that are discussed in detail hereinafter.

The Zils patent discloses a straight drive type of tool wherein the socket and hex key approach the workpieces at right angles relative to the general plane of the workpieces. The Zils tool has the disadvantage that if the key is damaged or broken, disassembly of portions of the head assembly of the tool is required in order to remove and replace the hex key. It also has the disadvantage that the key may be difficult to remove because of sealant fouling, and a twisted hex key may not even be removable for replacement, or may damage the key holder, requiring almost complete disassembly of the tool head for removing the stuck key and its key holder. These disadvantages translate into substantial manual effort and tool down-time.

The Bochman patent discloses a geared L-head-type tool that might be applicable to a Hi-Lok-type frangible fastener, although there is no mention of a frangible fastener in this patent. Replacement of the key would require disassembly of a subhousing which houses an enlarged key head and key spring from the main tool head. This would require substantial manual effort and tool down-time.

The Bosten patent discloses a power tool which, by its nature, could be applied to a Hi-Lok-type frangible fastener, although its stationary key has a Phillips screwdriver-type head. It is a straight, offset drive which would require substantial disassembly, and hence manual effort and tool down-time, to remove and replace the bit or key. The Bangerter et al. patent is a straight drive power tool which is generally similar to the tools disclosed in both Bosten and Zils, but has a torque-limiting clutch associated with the bolt-restraining bar. As with both the Bosten and Zils devices, the Bangerter et al. device would require substantial disassembly to remove and replace a broken bar or key, requiring substantial effort and down-time. The binding problem discussed in connection with Zils would also be equally applicable to Bosten and Bangerter.

Three Currently Used Hex Key Retention Systems

There are only three hex key retention systems currently in common usage. These are (1) the ball detent system disclosed in the two Batten patents, (2) a set screw retention system, and (3) a rollpin retention system. The only one of these three systems disclosed in the prior art patents cited above is the ball detent system, and applicant has given careful attention to that system because the present invention is likewise a quick-release and replacement system for the hex key, but eliminates many problems associated with the ball detent system.

In the following discussions of the three currently used hex key retention systems, various problems associated with the three systems will be addressed, and for direct comparison, features of the present invention which eliminate these problems will be discussed.

All three of these prior art hex key retention systems are employed with air motor-powered tools which utilize eight different lengths of socket members, one that is flush with the tool head assembly, and seven different extended socket lengths, ¼ inch, ½ inch, 1 inch, 1½ inches, 2 inches, 2½ inches, and 3 inches. Associated with these eight different socket lengths are seven different socket hex diameters, 7/32 inch, ¼ inch, 9/32 inch, 5/16 inch, 11/32 inch, ⅜ inch, and 7/16 inch. Four different hex key sizes are employed, 1/16 inch, 5/64 inch, 3/32 inch, and ⅛ inch. Each hex key is retained in a tubular key holder which extends into or through an axial bore in the socket member.

These three hex key retention systems apply to all three of the following Hi-Lok-type fastener installation tools: (1) 20° ratchet head assemblies (the general longitudinal axis of the ratchet head is 20° offset from the general longitudinal axis of the handle which contains the air motor); (2) straight ratchet head assemblies (the general longitudinal axes of the ratchet head and handle are axially aligned); and (3) pistol grip geared L-head assemblies (with various offset lengths of L-heads). Pistol grip straight drive installation tools require an entirely different type of hex key retention system (in these tools, the air motor body and drive head assembly are axially aligned and the drive head assembly is applied to the workpieces generally at right angles. Hex key retention systems for this straight drive-type installation tool will be discussed in a later part of this "Prior Art" section of the specification.

Ball Detent Hex Key Retention System

In the ball detent system, each of the four hex key sizes requires a separate key holder for each of eight different key holder lengths that are required by the eight different socket lengths. Thus, 32 holders are required in the ball detent system, in turn requiring an undesirably large and expensive inventory of parts. In the present invention, each key holder accommodates each of the four sizes of hex keys, so that only eight holders are required for the eight different socket lengths. Thus, only one-quarter the number of holders is required in the present invention as the number of holders required in the ball detent system.

Ball detent systems currently in use employ two diametrically opposed balls rather than the single ball disclosed in the Batten patents. In the ball detent system, each of the 32 holders is undesirably complex and requires an undesirably large number of manufacturing steps in production. Thus, in the ball detent system: (1) each of the 32 holders requires a pair of opposed, radially inwardly opening bores through which the balls are exposed to the removable hex keys; (2) each key holder requires a pair of connecting counterbores for receiving the pair of balls; (3) each key holder requires a pair of ball-retention overlaps in the outside ends of these counterbores to retain the balls in the holder; (4) each of the holders requires two balls which must be assembled in the holder; and (5) each of the holders has a broached hex recess in its forward end. In the present invention, each of the eight holders is a simple headed tube with a broached hex recess opposite the head, and a simple headed retention shaft with a threaded end opposite the head is in the holder.

The hex key embodied in the ball detent system is a thin shaft which is hexagonal and of the same cross-sectional size along almost all of its entire length, except for a tiny annular rearward end portion. The key has a reduced annular external retention recess forwardly adjacent the small annular rearward end portion. By way of comparison, the hex key of the present invention has a radially enlarged body portion with a rearward external hex locator and a rearwardly opening threaded bore, and a reduced diameter forward hex wrench portion. The hex keys of the ball detent system and the present invention are generally equally simple to manufacture.

Despite the intent for the ball detent hex key retention system to be a quick-release and replacement system, it has a number of characteristics which often make it difficult if not impossible to remove and replace a damaged or broken hex key. With the ball detent-type retention system, the key has to be manually pulled out of the front end of the holder, which requires a separate gripping tool such as pliers. For removal and replacement of the hex key, the ball detent system requires that the key holder be pulled rearwardly against the force of the retention spring, and then a "flipper" or spacer block be pivoted under the head of the holder to bring the ball detents in the holder into axial registry with the internal annular groove in the socket member. The retention springs are sometimes so rigid as to require a special tool to pry them up in order to get the flippers underneath them.

Another problem with the ball detent retention system is that contamination entering the interface region between the hex key and the holder keyway, as by sealant for corrosion proofing or wet wing areas, often prevents extraction of the key from the key holder. There is no through bore in the holder through which the key could be punched out. If the key cannot be removed from the holder, then the holder must be discarded. In the ball detent retention system, the thin, unreinforced key is vulnerable to breaking off at the holder front edge due to over-torquing or fatigue from extended use. When this happens, the key, whether simply damaged or broken off, usually cocks in the keyway of the holder, and may become jammed and difficult or impossible to remove. Again, there is no through bore in the key holder, through which the key could be punched out from the rear, so the holder would have to be discarded. Further, there is no mechanical advantage involved in the removal procedure; it has to be a straight pull-out. In the event the key should become stuck in the holder, either from sealant or cocking of a damaged key in the keyway, it is necessary in order to remove the holder to pry the retention spring cross-head laterally out of the holder cross-hole, and some of the retention springs are too rigid to be simply pried out of the cross-hole, in which case the operator must seek out a special tool to do this. All of this translates into costly tool down-time and operator effort.

With the present invention, for removal and replacement of the hex key, there is no need to rearwardly axially shift the hex key holder against the force of the retention spring to a predetermined extent for releasing ball detents, and particularly against the force of the retention spring, or to use a flipper lever to gauge the amount of axial shift. All that is necessary is to simply unscrew the retention shaft, and the hex key will be automatically ejected. The retainer is not axially shifted during key ejection. The retention spring cross-head axially interlocks the retention shaft and key holder during the unthreading ejection process, regardless of any binding of the key in the holder as by sealant. Ejection has the mechanical advantage of threaded ejection instead of straight-pull ejection, easily overcoming any sealant binding.

The hex key of the present invention is less vulerable to damage than that of the ball detent-type hex key. The continuous small cross-section hex key of the ball detent system extends out through an abrupt, sharp aperture at the front of the holder. If the key is over-torqued or inaccurately aligned with the fastener pin, a torque stress concentration is applied to the thin key cross-section at the holder opening, making the key vulnerable to shearing at the aperture of the holder, and if the key is broken off at that point, it becomes difficult or impossible to retrieve from the holder, which could result in the holder having to be discarded. In the present invention, the key has a greatly cross-sectionally enlarged body where it enters the holder, with greatly reduced torque concentration and no possibility of being sheared apart proximate the point of entry into the holder. Additionally, the hex key torquing shaft of the invention at its root is radiused out to the enlarged body, further avoiding stress concentration at any point along the length of the key. If the hex key of the invention should break, it will always break away from the holder; and there is no possibility of the key becoming jammed in the holder from twisting, because it is the enlarged body of the hex key that is in the holder, rather than the torquing shaft portion of the key.

Perhaps the most important disadvantage of the ball detent retention system is that in order to adapt the ball-lock hex key, its holder, and the socket member to other types of Hi-Lok installation tools (for example, tools originally adapted for either set screw or rollpin hex key retention), a special conversion kit must be installed in the tool drive head which includes a flipper spacer block. Also the ball-lock system requires special socket members with enlarged bores to accommodate the ball detents, so a complete new set of sockets would have to be produced to accommodate the conversion to a set screw or rollpin system. Here, one is looking at eight socket lengths, with at least seven different socket wrenching cavity sizes, or at least 56 new sockets that must be provided with the conversion kit.

In contrast, the present invention is adaptable to the ball lock installation tool without any conversion kit or exchange of socket members. The holders, retention shafts and hex keys of the invention fit the socket members of all three conventional Hi-Lok installation tools, including not only the ball-lock tools but also the set screw and rollpin tools.

Accordingly, all of the foregoing advantages of the present invention over the ball-lock retention system may be embodied in original ball lock tooling by simply replacing the ball-lock holders and keys with the holders, retention shafts and hex keys of the invention.

Set Screw Retention System

In the set screw retention system, a tiny set screw threads into a transverse bore in the key holder and engages against a thin hex key shaft, which is uniform along the length of the hex key. Removal and replacement of the hex key is very tedious. Thus, to remove and replace the hex key, the key holder must be removed from the tool head. To accomplish this, the retention spring needs to be disengaged from the key holder, the holder withdrawn from the socket member, the set screw removed from the holder by means of an Allen wrench, the hex key removed and replaced, the set screw replaced, the holder replaced, and the retention spring reengaged with the holder. Many retention springs are so stiff that they must be disassembled from the tool head in order to accomplish this. As with the ball detent system, the hex key system requires 32 holders, instead of only eight for the present invention. As with the ball detent system, in the set screw system contamination, as by sealant, usually prevents removal of the key, requiring replacement of both the key and holder. The key is vulnerable to breaking off at the front edge of the holder as in the ball detent system, making the remainder of the key difficult or impossible to remove from the holder, again requiring that the holder be discarded. The set screws are very tiny and vulnerable to damage, being only approximately 50/1000 inch in diameter, which is required by the nature of the tool. It is common to strip the head off of the set screw by over-torquing the set screw. This requires replacement of both the holder and hex key. Also, the set screws are so tiny, both axially and diametrically, as to be hard to handle and easy to lose. Again, all of this translates into expensive tool down-time and operator effort.

Rollpin Hex Key Retention System

The rollpin-type hex key retention system has essentially the same disadvantages as pointed out in detail above for the set screw hex key retention system, except that only eight of the key holders are required. In addition, the rollpins are so very tiny and thin-walled that they are readily sheared off at opposite sides of the holder into three pieces, particularly with the larger sizes of keys which have relatively high operational torque. Such shearing off of the rollpin requires removal of the holder from the tool head, punch-out of the rollpin pieces from both the holder bore and the hex key bore, replacement of the rollpin, and then replacement of the holder and key into the tool body. It is very cumbersome to get the tiny rollpins in and out of the key holder and key, and this may require a special bench tool for insertion and/or removal of the rollpin.

Pistol Grip Straight Drive Installation Tool

Hi-Shear Corporation, American Pneumatic, United Tool, and other tooling companies manufacture a pistol grip, pneumatically powered Hi-Lok installation tool in which the air motor housing is axially aligned with what amounts to a gear box and with a socket member at the forward end of the gear box, the socket member containing a hex key holder and its hex key. An example of the gear box is Hi-Shear's HLG101 gear housing assembly. This gear housing assembly provides for rotary power to be transferred from the air motor output to the socket member, while nevertheless restraining the key holder and key from rotation, while still allowing for axial retraction of the holder and key against spring biasing force in the housing assembly. Details of a generally similar housing assembly are shown and described hereinafter in connection with the pistol grip straight drive installation tool of the present invention.

A serious problem with these prior art pistol grip straight drive installation tools is the very large inventory of hex key holders required. There is a separate dedicated holder for each of the seven socket hex drive sizes, and there are two socket lengths for each of the seven socket hex drive sizes, a short 2-inch socket length and a long 4-inch socket length, and these different socket lengths require different length holders. Thus, there are 14 separate dedicated holders to accommodate the 14 different sockets required in the set. To further complicate the matter, each of the four hex key sizes requires a separate dedicated holder, so four more of each of the 14 holders that are dedicated to the socket sizes and lengths must be provided, making a total of 56 dedicated holders.

In contrast, in the pistol grip form of the present invention, the same key, key holder, and retention shaft are employed for both of the socket lengths and for all seven of the socket hex sizes, and they are not dedicated to hex socket sizes or to hex key sizes. Thus, in the present invention, there are only two key holders required, to accommodate the two socket lengths, instead of the 56 key holders required for the two socket lengths in the prior art pistol grip straight drive Hi-Lok installation tools. Each of these two holders in the present invention fits all four key sizes, and fits all seven socket hex sizes of either the short socket or the long socket. This is a dramatic difference in inventory. The socket assembly of this form of the present invention, including the holder and hex key, fits the Hi-Lok HLG101 gear housing assembly, and the similar assemblies of the other manufacturers of pistol grip straight drive Hi-Lok fastener installation tools.

Another problem with typical prior art pistol grip straight drive installation tools is that they employ a straight hex key of uniform cross-section in a holder keyway, wherein the key is retained by a radial set screw through the wall of the retainer. This construction has all of the problems pointed out hereinabove, except for the retention spring problem, since the straight drive installation tool doesn't use that type of retention spring. In most prior art devices of this type, in order to remove and replace the hex key, the socket is detached from the gear box output drive hex by releasing a set screw, and the key retainer and hex key removed from the rear of the socket. Then the retainer set screw is backed away from the key, and the key removed and replaced, if possible. If not, both the retainer and the key have to be discarded and replaced. In one prior art device of which applicant is aware, a cross-hole is provided in the socket which is in registry with the holder set screw so that the set screw can be backed off from the key without detaching the socket from the gear box output drive hex. However, if the key cannot be readily removed, as from sealant or being jammed from twisting, then the socket must be detached and the key removed from the holder externally of the socket, or if this cannot be done, the holder and key replaced.

In contrast, applicant employs the same key as described above for the other installation tool forms, which cannot be jammed. Also, applicant's key is threadedly coupled to the retainer through applicant's retention shaft, and when ejected for replacement there is the mechanical advantage of the threading, instead of a straight pull or push on the key which has no mechanical advantage.

SUMMARY OF THE INVENTION

In view of these and other problems in the art, it is a general object of the present invention to provide a Hi-Lok-type frangible fastener installation tooling system which is a substantial improvement over conventional Hi-Lok installation tool systems currently in use, in numerous respects.

Another general object of the invention is to provide a Hi-Lok installation tooling system in which there is a greatly reduced inventory of parts required for each installation tool, thereby minimizing the cost of tooling production, saving valuable operator and tool downtime because of simplified selection of parts, and saving tool crib storage space.

Another object of the invention is to provide a novel Hi-Lok installation tooling system having a true quick-release and replacement retention system for the hex key, yet which is greatly simplified relative to the ball detent hex key retention system, and is not vulnerable to failure in operation like the ball detent retention system.

Another object of the invention is to provide a quick-release and replacement hex key retention system which utilizes a simple and inexpensive threaded arrangement, as opposed to the much more complicated ball detent arrangement of the prior art.

Another object of the invention is to provide a threaded hex key retention system which gives "inclined plane" mechanical advantage during hex key removal, whereas the ball detent retention system, and other retention systems including set screw and rollpin systems, are straight pull-out systems without any mechanical advantage.

Another object of the invention is to provide a threaded hex key retention system which enables simple manual twisting of an external knurled head for key ejection, without need for any pull-out tool such as pliers.

Another object of the invention is to provide a Hi-Lok tool system of the character described wherein the same hex key is employed for all socket lengths, socket hex sizes, and with all tubular key retainers in all forms of the invention, including but not limited to 20° ratchet head assemblies, straight ratchet head assemblies, pistol grip geared L-head assemblies, manual installation tools, and pistol grip straight drive installation tools.

A further object of the invention is to provide a Hi-Lok installation tool of the character described wherein only eight tubular key holders are required in the ratchet head and geared L-head forms of the invention, to accommodate the eight different socket lengths; in contrast to 32 holders required in some prior art Hi-Lok installation tooling systems.

A further object of the invention is to provide a Hi-Lok installation tooling system of the character described, wherein only two tubular key holders, of different length, are required in the pistol grip straight drive form of the invention, as compared to 56 dedicated holders required in prior art tooling systems of this kind.

A further object of the invention is to provide a Hi-Lok installation tooling system of the character described, wherein the hex key is not vulnerable to shearing at the entrance to the key holder, as it is in prior art retention systems, and also is not vulnerable to having its shank stuck in the holder keyway, either by such shearing, or by twisting or sealant binding.

A further object of the invention is to provide a Hi-Lok installation tooling system wherein, in the ratchet head and geared L-head forms, hex key ejection and replacement from the key holder is by simple external manual rotation of an externally exposed, knurled head on a key retention shaft with the key holder remaining in place in the socket; instead of requiring that the key holder be removed from the socket as in the set screw and rollpin key retention forms, which is often difficult because a stiff retention spring must be removed laterally from the holder; and instead of the key holder having to be shifted rearwardly against the force of the retention spring and a flipper block having to be pivoted under the head of the holder, as in the ball detent-type retention system.

A further object of the invention is to provide a Hi-Lok installation tooling system of the character described, wherein the forward hex wrenching part of the key flares rearwardly into an enlarged cross-section body which is the part of the key that is engaged in the holder, minimizing localized stress zones along the length of the key, and making it essentially impossible for the key to become stuck in the holder by twisting.

A still further object of the invention is to provide a Hi-Lok installation tooling system of the character described, wherein even if the hex key should become stuck in the holder from sealant binding, it can easily be removed because of the high mechanical advantage of its threaded retention means.

A still further object of the invention is to provide a Hi-Lok installation tooling system of the character described, wherein the key holders, retention shafts, and hex keys of the invention fit the socket members of all three conventional Hi-Lok installation tools, including the ball lock, set screw, and rollpin tools.

A still further object of the invention is to provide a Hi-Lok installation tooling system of the character described which has only relatively large, sturdy and durable parts that are not liable to any damage during operation or during assembly and/or disassembly, and are convenient to manipulate; as distinguished from set screw retention systems wherein the set screws are tiny and hard to handle and easy to lose, and have heads likely to shear off; and as distinguished from rollpin retention systems, wherein the rollpins are also tiny and hard to handle, and are likely to shear apart into three pieces if over-torqued, and difficult to remove when sheared apart.

Yet a further object of the invention is to provide a manual Hi-Lok installation tool which utilizes the same hex keys, tubular key holders, retention shafts, and sockets as the ratchet head and geared L-head forms of the invention.

The present invention is a tooling system and method for installing Hi-Lok-type frangible aerospace fasteners. The invention is in most instances embodied in power-drive installation tools, such as 20° ratchet head, straight ratchet head, geared L-head, and pistol grip straight drive tools. It is also embodied in a manually actuated tool.

In the ratchet head forms of the invention, except for the flush head form, a ratchet drive gear is rotatably supported between a pair of spaced drive head plates, the drive gear having an axial hex through bore which receives a complementary external hex on a drive socket member of the tool. The forward, free end of the socket member has a forwardly opening driving hex socket recess which is engaged over the torque-off nut of the collar component of the fastener, and for a fastener installation event the ratchet gear rotates the socket to drive the collar body of the fastener down on the pin into clamping engagement with the workpieces until the torque-off nut of the fastener is broken off from the collar body at a predetermined preload.

A rotationally stationary hex key coaxial within the forward end portion of the socket is engaged in the hex recess of the fastener pin component, the hex key being held rotationally stationary by a novel combination of tubular key holder and coaxial retention shaft.

The hex keys of the invention represent a major departure from prior art hex keys, having a radially relatively large rearward body portion which supports a radially relatively small forwardly projecting hex torquing shaft portion, with a radiused connection between these two portions. The enlarged rearward body portion is of the same size and configuration for all tooling of the invention, in particular for all socket lengths and socket hex drive sizes. Only four different hex keys are required in the invention, to accommodate the four conventional hex sizes which are 1/16 inch, 5/64 inch, 3/32 inch, and ⅛ inch.

The tubular key holder of the invention has a hex socket at its forward end which receives an external hex on the key body for holding the key rotationally stationary, the holder having an elongated cylindrical barrel which extends through a cylindrical bore in the socket, the holder terminating at its rear end in an enlarged head at the rear end of the socket, the socket being rotational relative to the holder.

The retention shaft extends coaxially through the tubular holder, making a threaded connection at its forward end with the key body, and having a head that overlies the holder head. The retention shaft is rotationally independent of the holder, and its head is peripherally knurled for manual rotation of the retention shaft relative to the holder in order to threadedly eject one key from the holder and threadedly install another key in the holder through the threaded connection between the retention shaft and key, during which time the key is held against rotation by its hex connection with the holder. The holder in turn is held against rotation by means of an external retention spring that has a cross-head engaged through a slot in the holder head. The spring cross-head registers with a groove in the retention shaft, allowing the retention shaft to be manually rotated relative to the holder, but holding the retention shaft and holder in fixed axial relationship. Only eight holders and retention shafts are required in the invention, to accommodate the eight conventional socket lengths, which are flush, ¼ inch, ½ inch, 1 inch, 1½ inches, 2 inches, 2½ inches, and 3 inches. All lengths of the holders and retention shafts apply to the same hex key, and to the seven socket hex sizes, which are 7/32 inch, ¼ inch, 9/32 inch, 5/16 inch, 11/32 inch, ⅜ inch, and 7/16 inch. Since only four hex key sizes and eight holder and retention shaft sizes are required, the tooling inventory of the present invention is greatly reduced relative to the tooling inventory required in prior art systems.

During operation of a ratchet head tool according to the invention, while the socket member is rotated by the ratchet gear to threadedly drive the fastener collar down onto the fastener pin, and the assembly of hex key, key holder, and retention shaft holds the pin against rotation, the retention spring gives to allow rearward shifting of the key, holder, and retention shaft assembly to accommodate forward threading movement of the collar relative to the pin.

The present invention is also applied in a flush ratchet head assembly form which differs from the other ratchet head forms only in that the ratchet gear and socket member are combined as a single unit. Thus, the ratchet gear has a forwardly opening hex drive socket therein, and has a cylindrical bore therethrough for receiving the assembly of hex key, key holder, and retention shaft. This is the shortest form of the key holder and retention shaft, and the same hex key is employed as with the other forms.

The geared L-head form of the invention is the same as the flush form of the invention, excepting only for the L-head configuration and employment of a spur drive gear in place of the ratchet drive gear. If desired, extended socket members may be employed in the L-head form of the invention, in which case the spur drive gear will have a hex bore therethrough for receiving the external rearward hex on the extended socket member.

The pistol grip straight drive installation tool of the invention has a geared drive system that is similar to those of conventional pistol grip straight drive tools, but has a drive head that is totally unique in the art, enabling the same hex key to be employed that is employed in the other forms of the invention, and enabling this same key to be employed for both socket lengths, the short (2 inch) and long (4 inch) socket lengths, and for all seven of the socket hex recess sizes. Although the key holder and retention shaft of the pistol grip straight drive tool of the invention differ from those of the other forms of the invention, the same holder and retention shaft are employed for all seven of the socket drive hex sizes for the short socket, and the same, longer holder and retention shaft are employed for all seven hex socket sizes of the long socket. Thus, only two key holders and two retention shafts are required in the pistol grip straight drive form of the present invention. The same hex key applies to both sizes.

In the pistol grip straight drive form of the invention, an externally cylindrical connector fits within an extended, rearwardly opening bore of the socket member, and normally seats against a rearwardly facing shoulder in the socket member. Rotary power is transmitted through a gear box to the socket member, the socket member being mounted on a a drive shaft which protrudes from the gear box, with a hex connection between the rear end portion of the socket member and the power output drive shaft. An extension rod extends from within the gear box through a bore in the drive shaft, being fixed against rotation by a floating guide plate within the gear box, and biased forwardly by spring means in the gear box. The extension rod has an external hex at its forward end which is seated within a rearwardly opening hex recess in the connector which is in the socket bore, biasing the connector to its normal forwardmost position within the socket. The key holder and retention shaft both have hex heads which are received within a forwardly opening bore of the connector. This bore has an annular forward portion and a hex rearward portion.

During operation of the tool to accomplish a fastener installation event, both of the holder and retention shaft hex heads are received in the rearward hex portion of the forwardly opening connector recess to hold the hex key against rotation, while the connector is held against rotation by the extension rod, the extension rod resiliently allowing rearward retraction of the hex key as required during the installation.

To remove one hex key and install another, the socket is separated from the drive shaft by quick-release means, the connector and hex key, holder, and retention shaft dropped as a unit out of the rear of the socket, and then the key is ejected while the holder and retention shaft remain operatively associated with the connector. This is accomplished by pulling the holder and connector to an axially extended condition so that the holder hex head is moved to the annular part of the connector recess, while the retention shaft hex head remains in the hex part of the connector recess. Then all that is required to eject the hex key is to apply relative rotation between the key holder and the connector, the hex key remaining rotationally stationary in the holder, and the retention shaft remaining rotationally stationary in the connector, the relative rotation between the holder and connector unthreading the retention shaft from the key and ejecting the key from the holder. Installation of a new hex key simply involves reversal of the relative rotation between holder and connector. When the new key is thus installed in the holder, the assembly of key, holder, retention shaft, and connector is dropped back into the socket from the rear, and the socket reengaged with the drive shaft by the quick-release means.

BRIEF DESCRIPTION OF THE DRAWINGS

These and other objects and advantages of the invention will become more apparent from the following description taken in conjunction with the drawings, in which:

FIG. 1 is an axial sectional view, with portions in elevation, of a Hi-Lok-type frangible fastener to which the invention is applicable, with the pin or bolt component thereof operatively placed in a hole through a pair of workpieces, and the body portion of the collar component initially threaded onto the threaded end portion of the pin or bolt component;

FIG. 2 is a view similar to FIG. 1, in which the installation tool has driven the body portion of the collar component down on the pin or bolt component so that the fastener is now in clamping engagement with the workpieces;

FIG. 3 is a view similar to FIGS. 1 and 2 in which the drive nut portion of the collar component has been torqued off of the body portion at a predetermined preload, to complete the fastener installation;

FIGS. 17-19 being similar to FIG. 16, except that all parts are shown in vertical, axial section;

FIG. 21 is a greatly enlarged fragmentary vertical, axial sectional view illustrating a flush ratchet head assembly according to the invention;

FIG. 22 is a fragmentary perspective view illustrating a geared L-head installation tool according to the invention;

FIG. 23 is a transverse, vertical sectional view taken on the line 23—23 in FIG. 22, illustrating the spur gear sequence in the head portion of the geared L-head installation tool, including the terminal socket hex drive spur gear;

DETAILED DESCRIPTION

Figure 4:
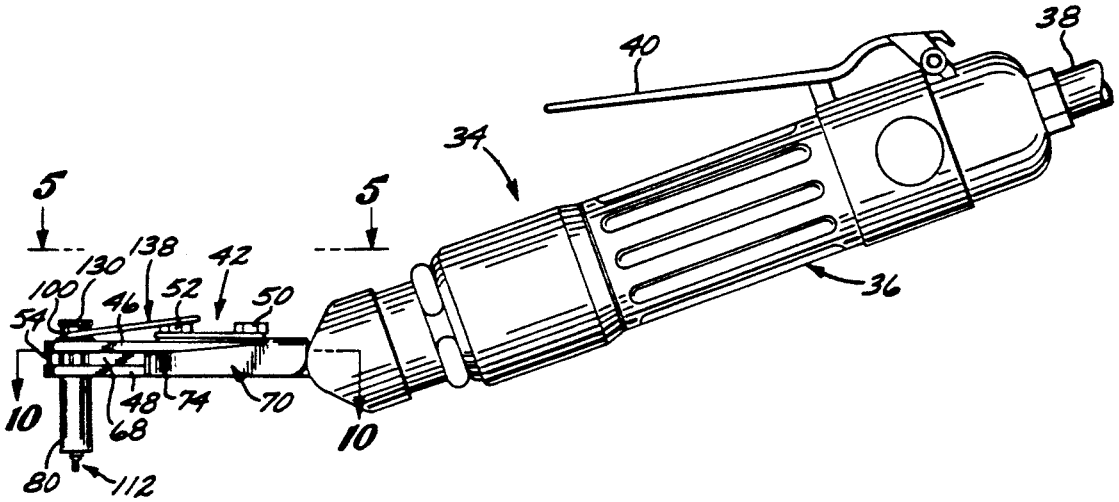
FIG. 4 is a side elevational view of a 20° ratchet head installation tool according to the invention.

FIGS. 1-3 illustrate a frangible-type threaded fastener of the Hi-Lok type referred to above in the Prior Art section, for which the present invention is particularly adapted. The frangible fastener is generally designated 10, and is illustrated in FIGS. 1-3 in a typical installation sequence for clamping together a pair of metal panels or workpieces 12 and 14 which typically may be panel portions of an aircraft wing spar. Although only a single fastener 10 is shown in FIGS. 1-3, conventionally an elongated series of regularly spaced fasteners 10 will be installed to secure panels 12 and 14 together. For clarity, the installation sequence of FIGS. 1-3 is shown without the presence of the installation tool of the invention. A similar installation sequence is also shown in FIGS. 12-15 with the installation tool of the invention applied to the fastener, illustrating the actuation of the installation tool and progression of the fastener installation and nut break-off as the installation procedure progresses.

Panels 12 and 14 are first temporarily clamped together in their final relative positions, and a series of holes 15 bored through panels 12 and 14 at right angles to the general planes of the panels. The frangible fastener 10 consists of a pin or bolt component 16 and a collar component 24. Pin 16 includes a head end portion 18 which, in this case, is of the countersunk flush type, and a shank 20 having a threaded end portion 22. It is to be understood that alternatively a protruding head-type pin or bolt may be employed. Collar component 24 includes an internally threaded body portion 25 that is threadedly engageable over the threaded portion 22 of pin shank 20 and threadedly clamped down against upper panel 12 (as viewed in FIGS. 1-3), while the head portion 18 of pin 16 seats against lower panel 14. Collar component 24 also includes a torque-off drive nut portion 26 at the free end of collar component 24 which is axially spaced from collar body portion 25 by means of an annular sleeve 28. Drive nut 26 has external hex drive flats which are engaged by complementary flats in the working end of a drive socket of the installation tool for rotatively driving collar body 25 down onto pin component 16. A torque-off groove 30 is provided in collar component 24 immediately above the collar body 25. A wrench cavity 32 in the form of a hex recess is broached into the threaded end portion 22 of pin 16 for receiving a complementary Allen-type hex key at the working end of the installation tool, this hex key being held rotationally stationary by the installation tool so as to hold pin component 16 of the fastener stationary during installation.

During the installation sequence, pin component 16 is first inserted through hole 15 from the back side of panels 12 and 14, or from the bottom as viewed in FIG. 1, and collar component 24 manually threaded a few turns onto the threaded portion 22 of pin component 16, as illustrated in FIG. 1. Then the working end of the installation tool is applied to rotationally drive collar component 24 while holding pin component 16 stationary, thereby driving collar body 25 down into clamping engagement against the workpieces as shown in FIG. 2. This torquing of collar component 24 proceeds to a controlled preload of the fastener 10, at which point drive nut portion 26 of collar component 24 breaks off from collar body portion 25 at torque-off groove 30 as shown in FIG. 3, leaving fastener 10 permanently installed in clamping engagement with the workpiece panels 12 and 14.

FIGS. 4-20 illustrate a 20° ratchet head installation tool according to the invention, which is generally designated 34. Ratchet head installation tool 34 includes a body portion 36 which contains an air motor driven by compressed air fed through a flexible hose 38. An actuating lever or trigger 40 pivoted on body 36 energizes ratchet head assembly 42 for performing an installation event. Ratchet head assembly 42 is connected to body 36 by means of a support plate 44 which projects forwardly from tool body 36 at a 20° angle relative to the axis of body 36. Spaced, parallel upper and lower ratchet head plates 46 and 48, respectively, are secured against the upper and lower surfaces of support plate 44 by means of a pair of longitudinally spaced bolts 50 and 52. A ratchet drive gear 54 is rotatably mounted between plates 46 and 48 by means of upper and lower respective annular pivot pins 56 and 58 on gear 54 which are journalled in bores 60 and 62 in respective upper and lower plates 46 and 48. Ratchet drive gear 54 has annularly arrayed, regularly spaced peripheral ratchet teeth 64 thereon. Ratchet drive gear 54 has a central hex drive through bore 66 which extends axially through the entire ratchet gear 54 including its annular pivots 56 and 58.

Ratchet drive gear 54 is driven by a longitudinally oscillating drive pawl 68, the front end of which is engaged in ratchet teeth 64, and the rear end of which is driven by a rotary pawl drive cam 69. The front end of drive pawl 68 is held in engagement with ratchet teeth 64 by means of a transversely biasing, generally longitudinally arranged pawl spring 70 which has a generally flat upper portion 72 that is clamped against upper plate 46 by means of bolts 50 and 52, and an elongated spring finger portion 74 the front end of which engages against pawl 68. A cog lever 76 between plates 46 and 48 is biased against ratchet teeth 64 by means of a wire spring 78 to assure continuous forward rotation of gear 54.

An extended, primarily annular socket member 80 is formed with a rearward external driven hex portion 82 which matingly fits through hex through bore 66 in ratchet drive gear 54. Socket member 80 has a rearwardly facing shoulder 84 at the forward end of its hex portion 82 which bears against the lower end of lower ratchet gear pivot 58 to serve as one axial locator for socket member 80. The rearward end portion of socket member 80 is located against the rear end of upper pivot 56 by means of a selectively releaseable spring clip or lock ring 86 which fits into an annular groove 88 in the rearward end portion of socket member 80 to serve as the other axial locator for socket member 80. Socket member 80 terminates at its rear end in a flat surface 90. The forward, wrenching end of socket member 80 is generally designated 92. Socket member 80 has an axial annular bore 94 extending through its length and terminating at the forward, wrenching end of socket member 80 in a forwardly opening hex socket 96 which has a beveled entry.

A tubular key holder 98 is provided which has a rearward head portion 100 and a forwardly extending externally cylindrical annular barrel portion 102. Barrel portion 102 extends in relative rotational relationship through the annular bore 94 of socket member 80, with head portion 100 of key holder 98 seating against the flat rear end 90 of socket member 80. Tubular key holder 98 has an axial bore extending through both its head portion 100 and its barrel portion 102, this bore through head portion 100 and most of the forwardly extending portion of barrel portion 102 has a cylindrical annular inner surface 104, and surface 104 ends in the forward end portion of barrel 102 in an internal forwardly opening hexagonal keyway 106. The forward end 108 of key holder 98 is proximate the flat inner surface 110 of hex socket 96.

The hex key of the invention is generally designated 112, and includes an enlarged rearward body portion 114 and a small axial forwardly projecting Allen-type hex torquing portion 116, with a radiused connection 118 between body portion 114 and torquing portion 116. Body portion 114 of hex key 112 has an external hex locator 120 which seats within the hexagonal keyway 106 of key holder barrel 102. A rearwardly facing shoulder 122 at the forward end of key hex locator 120 locates key 112 axially in holder 98. A rearwardly opening threaded bore 124 is provided in the rearward portion of key body 114.

An elongated key retention shaft or drawbar is provided which is generally designated 126, and includes an elongated annular shaft portion 128 and an integral externally knurled head portion 130. Shaft portion 128 has an externally threaded forward end portion 132 which is threadedly engaged within the threaded key bore 124 so as to draw hex key 120 into seated engagement within the holder hexagonal keyway 106. Retention shaft head 130 seats against holder head 100 when key hex locator portion 120 is fully seated within holder keyway 106.

Figure 6:
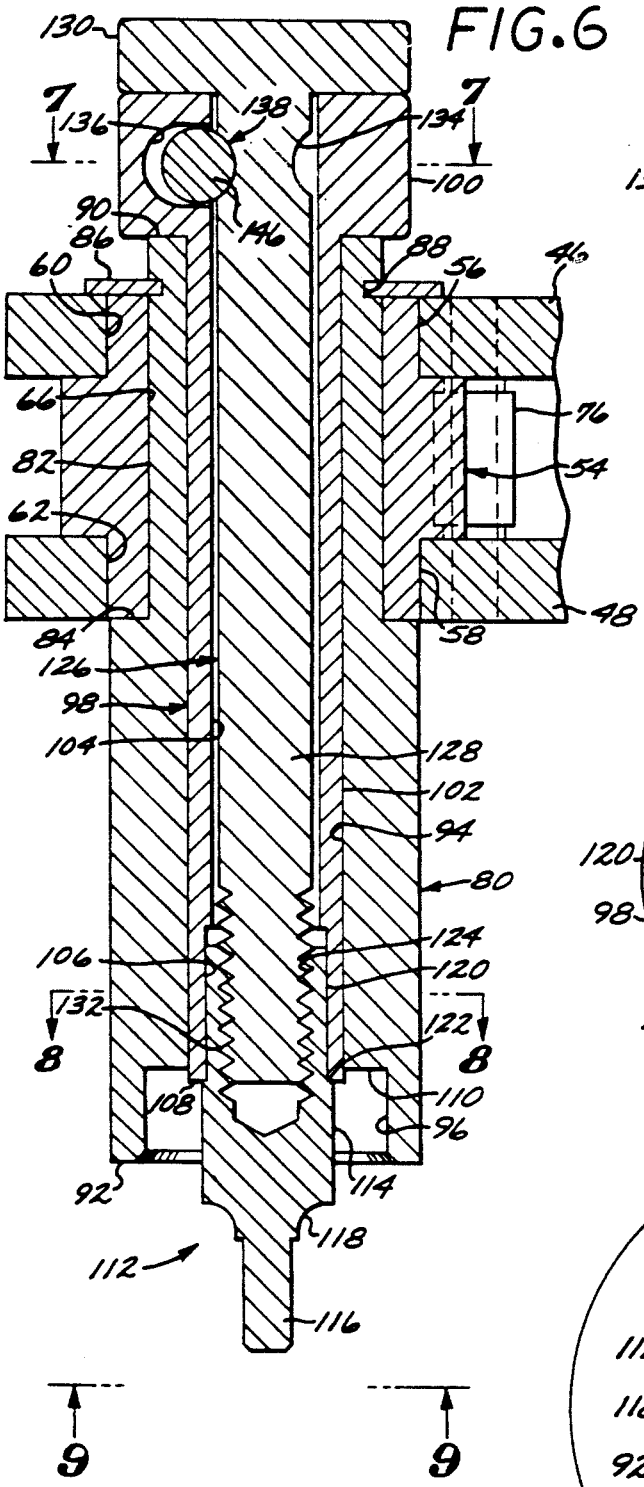
FIG. 6 is a greatly enlarged fragmentary vertical section taken on the line 6—6 in FIG. 5, showing principal components of the invention in axial section, including hex key, key holder, and retention shaft.
Figure 7:
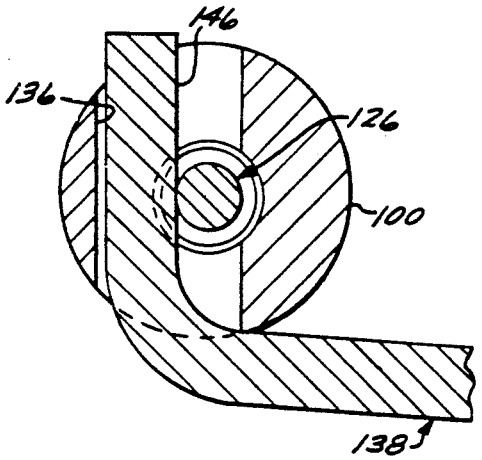
FIG. 7 is a fragmentary horizontal, transverse section taken on the line 7—7 in FIG. 6.
Figure 8:
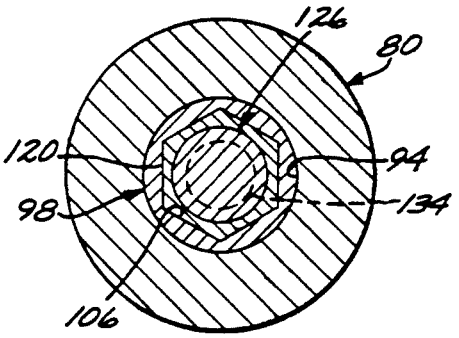
FIG. 8 is a horizontal, transverse section taken on the line 8—8 in FIG. 6.
Figure 9:
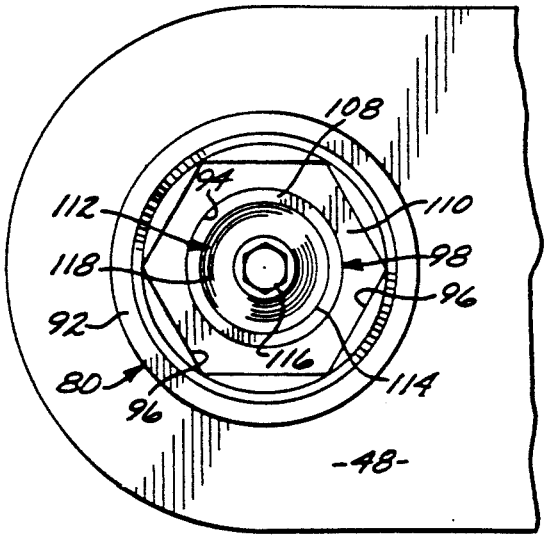
FIG. 9 is a fragmentary bottom plan view taken on the line 9—9 in FIG. 6.

With the tubular key holder 98, key 112 and key retention shaft 126 thus assembled, they become a functionally unitary assembly both axially and rotationally as seen in FIG. 6. Axial location of retention shaft 126 in holder 98 is provided at the rearward end by abutment of its head 130 against holder head 100, and at the forward end by abutment of key shoulder 122 against holder forward end 108. Rotational location between key 112 and its holder 98 and retention shaft 126 is provided by engagement of external key locator hex 120 in the holder hex receiver bore 106. This assembly of holder 98, key 112 and retention shaft 126 is nevertheless rotationally independent of the extended socket 80 because of the annular inner socket bore 94 and the annular outer surface of the holder barrel portion 102.

Shaft portion 128 of retention shaft 126 has an annular groove 134 therein which is arcuate in axial cross-section and spaced slightly below head portion 130 so as to be located within holder head portion 100. Holder head portion 100 has a slot 136 extending transversely therethrough which is in longitudinal registry with groove 134 and at least partly in transverse registry with groove 134. An elongated heavy wire retention spring 138 is provided for normally holding at its forwardmost position in socket member 80 the combination of key holder 98, hex key 112 and retention shaft 126, with holder head 100 seated against the rearward end 90 of socket 80. Retention spring 138 has an anchor loop 140 that is retained by bolt 50. Retention spring 138 extends from anchor loop 140 in an elongated arm 142 generally longitudinally of tool head 42 along pawl spring flat portion 72 and thence in an extension loop 144 which is a single helical loop spaced around the head of bolt 52. Retention spring arm 142 then extends over the top plate 46 of tool head 42, terminating in a short transverse cross-head portion 146 of spring 138 which is at approximately right angles to the general overall length of spring 138.

Spring head portion 146 extends through slot 136 in holder head 100 and within annular groove 134 of retention shaft 126. Spring 138 securely biases its cross-head portion 146 transversely (upwardly as viewed in FIGS. 5 and 7) so that spring cross-head portion 146 remains extended through slot 136 and within groove 134 during operation of the tool. Retention spring head 146 thus locks holder head 100, and hence holder 98, against rotation relative to tool head 42 during operation of the tool, while nevertheless enabling manual rotation of retention shaft 126 by means of its knurled head 130. Retention spring 138 also biases its transverse cross-head portion 146 forwardly or downwardly as viewed in FIG. 6 so as to normally bias holder head 100 against the rearward end 90 of socket member 80. Since key 112 is nonrotationally fitted within key holder 98, and is also axially fixed within holder 98, the torquing hex portion 116 of key 112 is held fixed against rotation during operation of installation tool 34. Nevertheless, during an installation operation it is necessary for hex key 112 to retract rearwardly within socket member 80, and this is permitted by rearward axial sliding of holder 98, key 112 and retention shaft 126 in socket 80 against the forward biasing force of spring cross-head 146. Also, a small amount of such retraction may be useful to accommodate varying heights of Hi-Lok-type fasteners 10.

It is notable that retention spring 138 of the present invention serves several synergistic functions. These are (1) retaining retention shaft 126 in tubular key holder 98; (2) retaining key holder 98 in socket member 80; and (3) biasing key holder 98, retention shaft 126 and hex key 112 (a) into their initial operational position, and (b) into their position for ejection of hex key 112 in the event of the forward torquing portion 116 of key 112 becoming twisted or broken.

Operation of the Installation Tool

Figure 12:
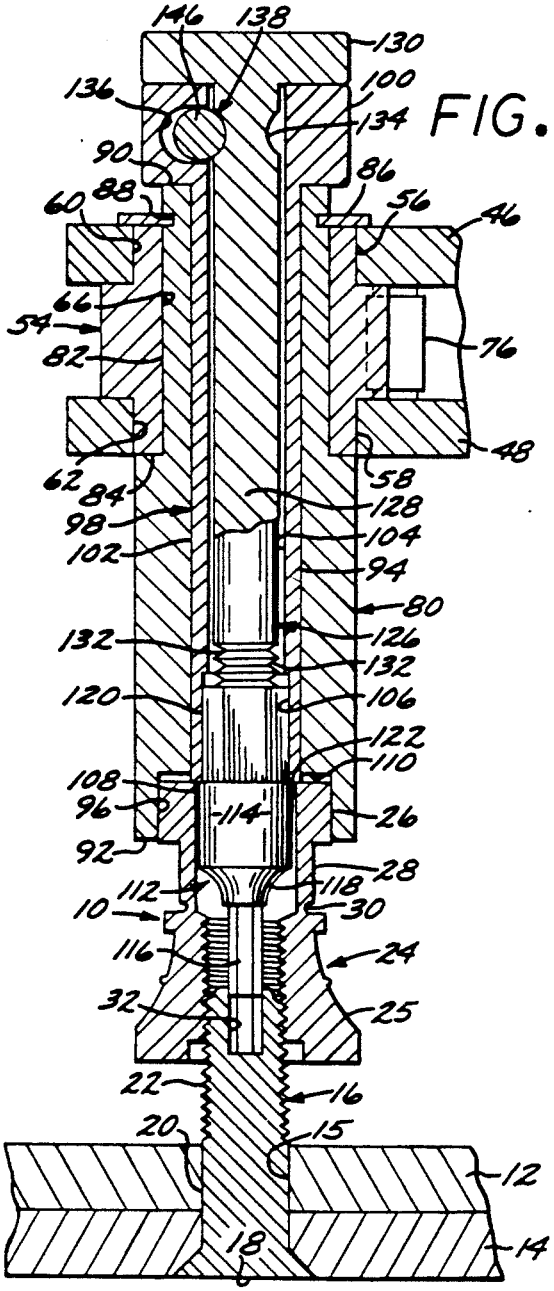
FIGS. 12-15 are enlarged vertical sectional views, with principal components of the invention shown partly in axial section and partly in elevation, illustrating an operational sequence in which the invention is employed to install a Hi-Lok fastener like that illustrated in FIGS. 1-3.

FIGS. 12–15 illustrate an operational sequence in which a Hi-Lok-type fastener 10 is installed by installation tool 34. In FIG. 12, the pin or bolt component 16 of the frangible fastener 0 has been inserted through a hole 15 from the back side of panels 12 and 14 which are being fastened, and body 25 of fastener collar component 24 has been threaded several turns onto the threaded free end portion 22 of pin 16. In FIG. 12, ratchet head assembly 42 of installation tool 34 has been lowered over the partially threadedly engaged fastener 10 with the air motor unactuated, and hex socket 96 in the forward end of socket member 80 coupled over the torque-off hex drive nut portion 26 of collar component 24. At the same time, the Allen-type hex torquing portion 116 of key 112 has been coupled into the hex wrench cavity 32 in fastener pin 16. At this point, hex key 112 is maintained in its forwardmost position as seen in FIG. 12 by the biasing force of retainer spring 138.

Figure 13:
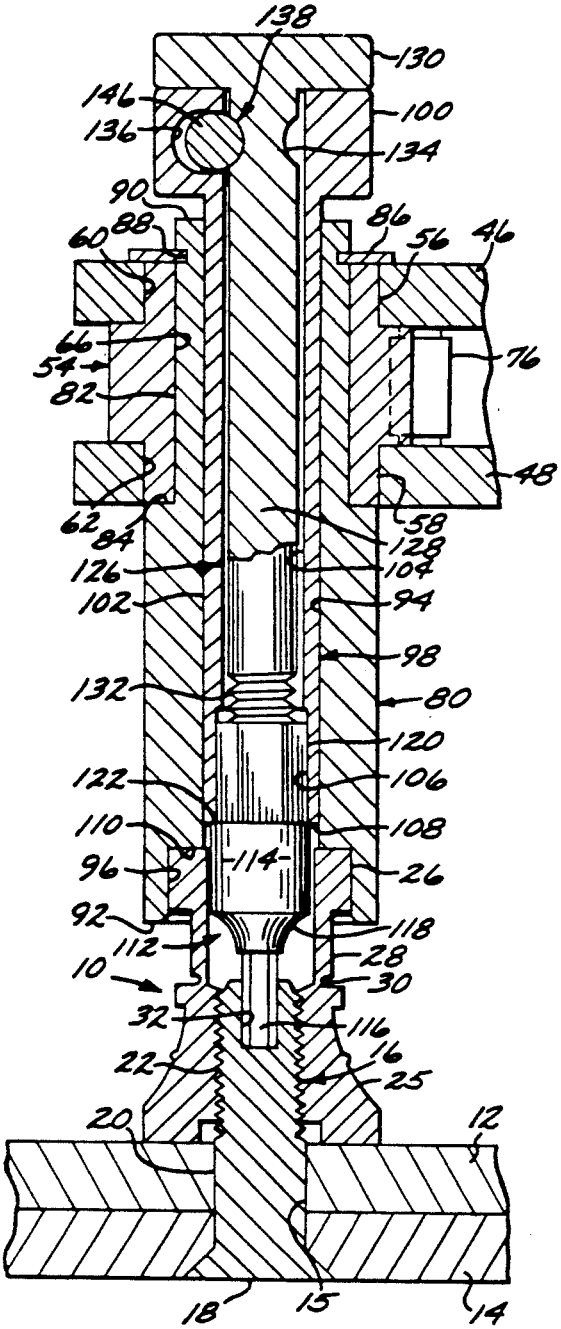

At this time, the operator holds ratchet head assembly 42 down against the fastener 10 and pivots lever 40 to actuate the air motor in body portion 36 of the tool. The air motor rotates pawl drive cam 69, which in turn translationally oscillates pawl 68 to rotate ratchet drive gear 54 in a "right-hand" direction, or clockwise as viewed from above in FIG. 12. Socket member 80 is synchonously rotated with ratchet drive gear 54 to rotate collar component 24 of fastener 10 and run collar body 25 down on pin 16 so that panels 12 and 14 are clamped between collar body 25 and pin head 18 as seen in FIG. 13. The torque-off groove 30 in collar component 24 is configured to produce break-off of drive nut 26 and nut sleeve 28 from collar body 25 at a predetermined torque which corresponds with a calculated preload clamp-up force of collar body 25 and pin head 18 against panels 12 and 14. This break-off torque has not been reached in FIG. 13, but has been achieved in FIG. 14.

It will be noted that as collar component 24 is being run down onto pin component 16, forward axial movement of socket 80 relative to hex key 112 is required in order for socket hex recess 96 to remain in engagement over drive nut 26. This is enabled by upward flexing of retainer spring 138 from its relaxed position of FIG. 12 to the flexed position of FIGS. 13 and 14, during which hex key 112, key retainer shaft 126 and holder 98 all shift rearwardly or upwardly as a unit. During the driving operation between FIG. 12 and FIGS. 13 and 14, hex key 112, retainer shaft 126 and holder 98 are all retained rotationally stationary relative to tool body 36, support plate 44, and upper and lower plates 46 and 48, respectively.

Figure 14:
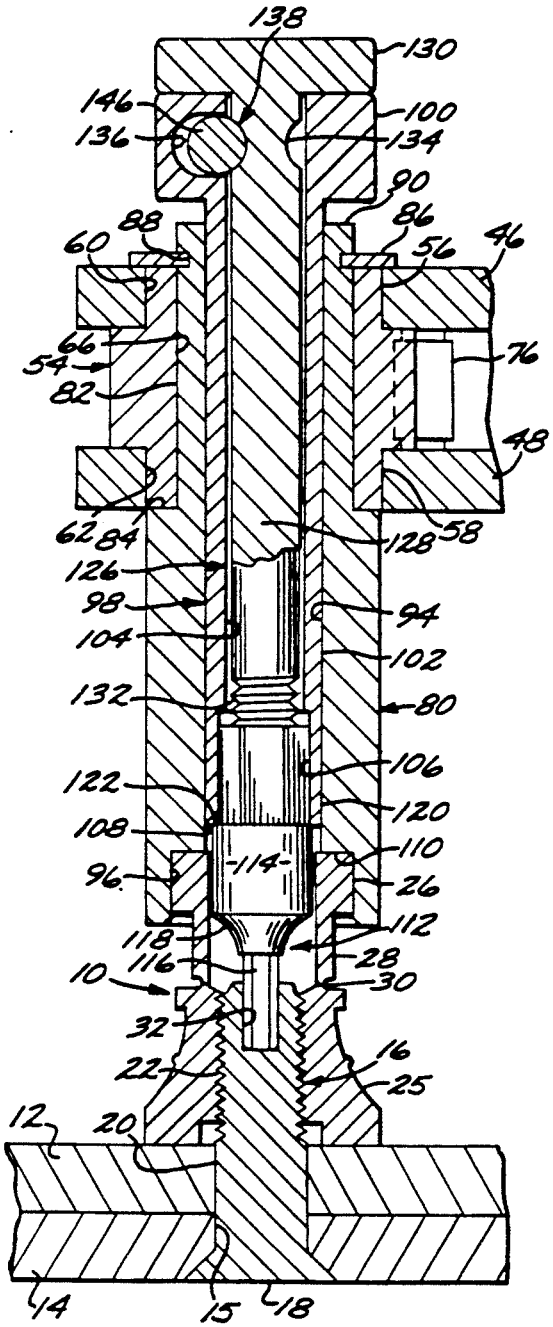
Figure 15:
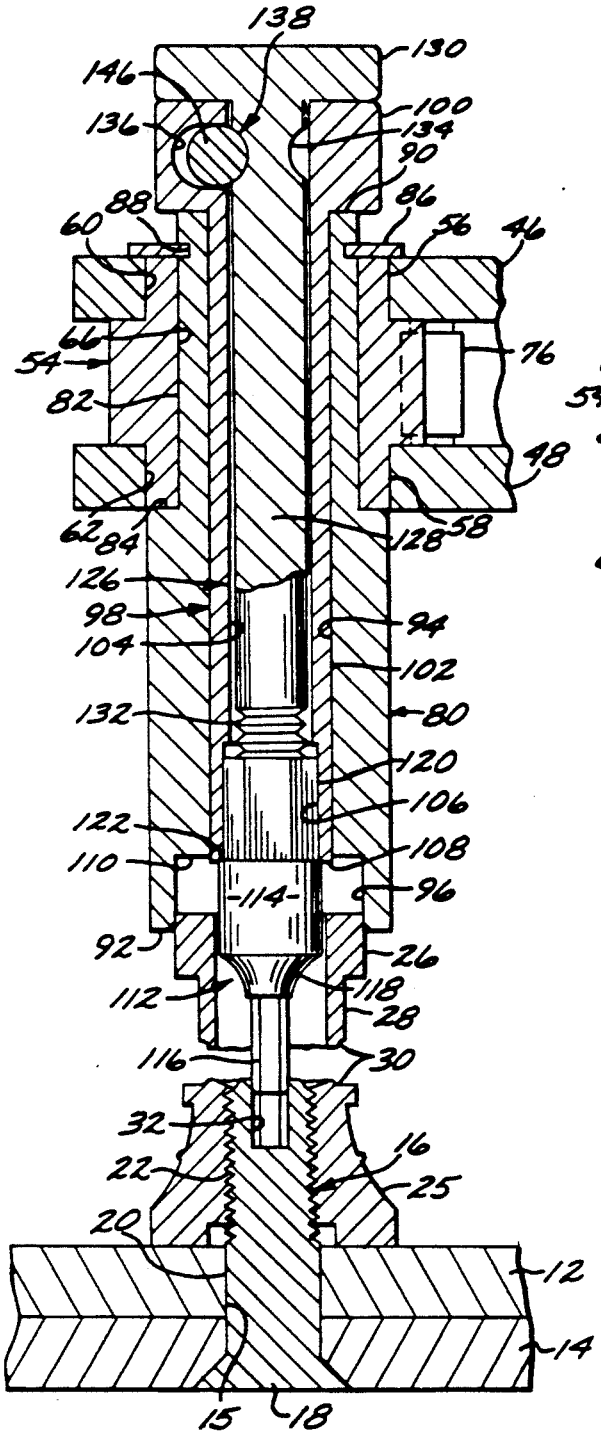

Upon break-off of collar drive nut 26 as seen in FIG. 14, ratchet head assembly 42 is lifted off of the completed fastener installation as seen in FIG. 15 and is ready for another fastener installation event. During such lift-off, hex key 112, retainer shaft 126 and holder 98 are all returned forwardly relatively to socket member 80 to their positions of repose seen in FIG. 12 by the forward biasing force of retainer spring 138 as applied through its cross-head 146.

Hex Key Removal and Replacement

An important feature of the present invention is the ease and simplicity of removal of one hex key 112 and replacement thereof with another hex key 112, either for providing the installation tool with a key 112 of a different size, or to remove and replace a damaged hex key 112. As previously described in detail in the "Prior Art" section, this removal and replacement procedure is much quicker and easier with the present invention than with prior art Hi-Lok fastener installation tools, requiring an absolute minimum of tool and operator downtime and corresponding maximum overall operator and installation tool efficiency.

Figure 16:
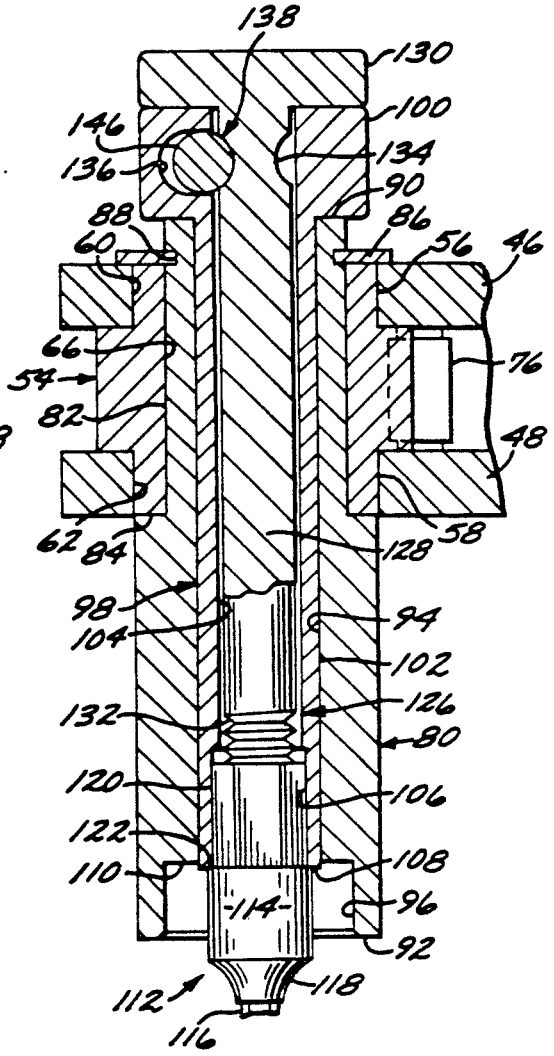
FIGS. 16-19 disclose an operational sequence for removal and replacement of a damaged hex key, FIG. 16 being a vertical section, with the socket and key retainer portions of the invention shown in axial section, the hex key shown in elevation, and the key retention shaft shown partly in axial section and partly in elevation.

FIGS. 16–19 illustrate a hex key ejection and replacement sequence for the present invention. In FIG. 16, the hex torquing portion of key 112 has been broken off, and requires replacement. In FIG. 16, hex key 112 is seen in its fully operative position, fully threadedly engaged with the threaded forward end portion 132 of key retention shaft or drawbar 126, with its external hex locator portion 120 seated in the hexagonal keyway 106 of tubular key holder 98. Hex key 112 is removable in the present invention without the necessity of dismantling any parts or even shifting the position of the cross-head portion 146 of retention spring 138 or key holder 98.

Figure 5:
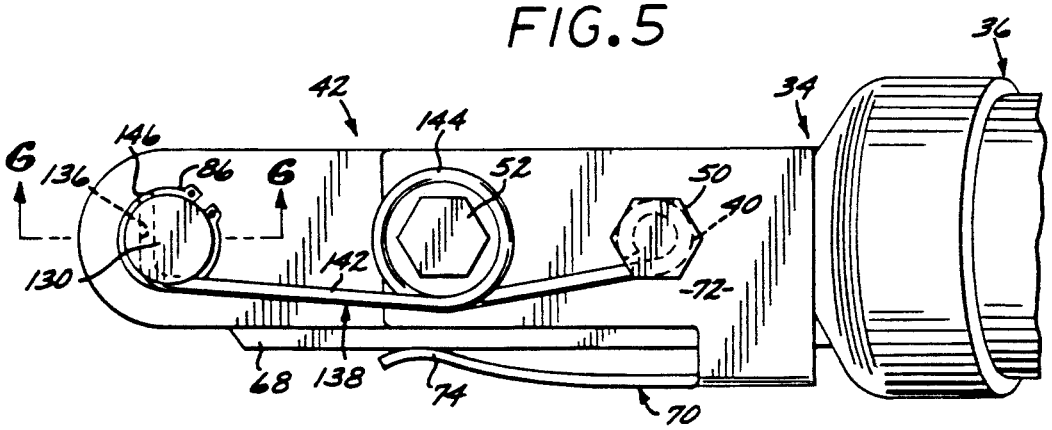
FIG. 5 is a fragmentary top plan view of the installation tool shown in FIG. 4, taken on the line 5—5 in FIG. 4.

All that is required is to manually grasp the knurled periphery of retention shaft head 130 and twist retention shaft 126 counter-clockwise as viewed in FIG. 5, so as to unscrew the internally threaded bore 124 of hex key body 114 from the externally threaded forward end portion 132 of retention shaft 126. Rotation of retention shaft 126 is permitted by the fact that retention spring cross-head 146 rides in annular groove 134 of retention shaft 126, and while retention shaft 126 is thus being rotated, hex key 112 is maintained rotationally stationary by engagement of its external hex locator portion 120 in hex keyway 106 of key holder 98.

In this manner, hex key 112 is simply and positively forwardly ejected from ratchet head assembly 42. During such ejection, sufficient forward ejection force will normally be provided by the forward biasing force of retention spring cross-head 146, but if necessary because of sealant binding between either hex key 112 and key holder 98, or key holder 98 and socket member 80, additional manual force may be applied against retention shaft head 130 during the ejection.

Figure 17:
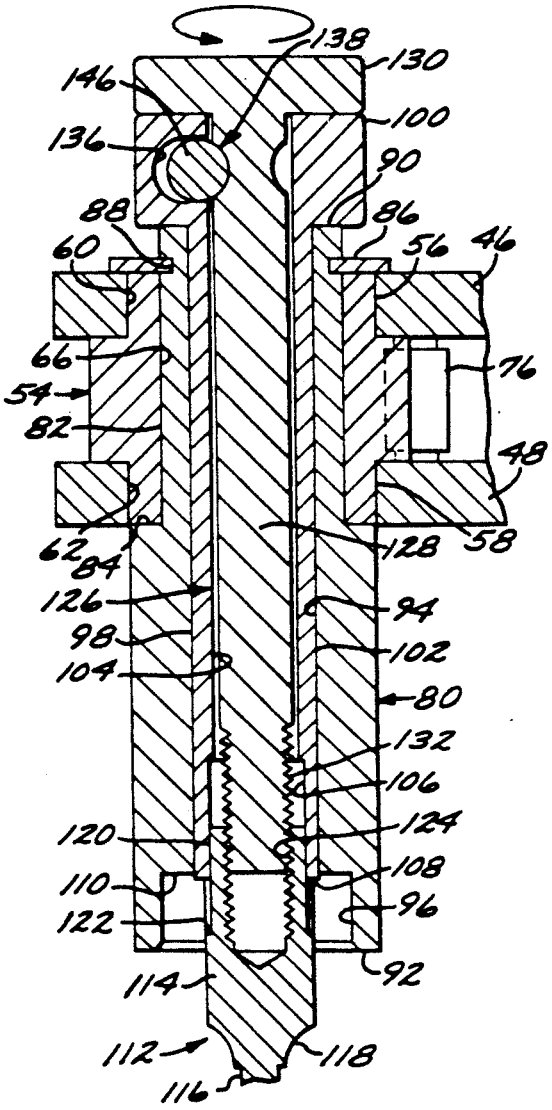
Figure 18:
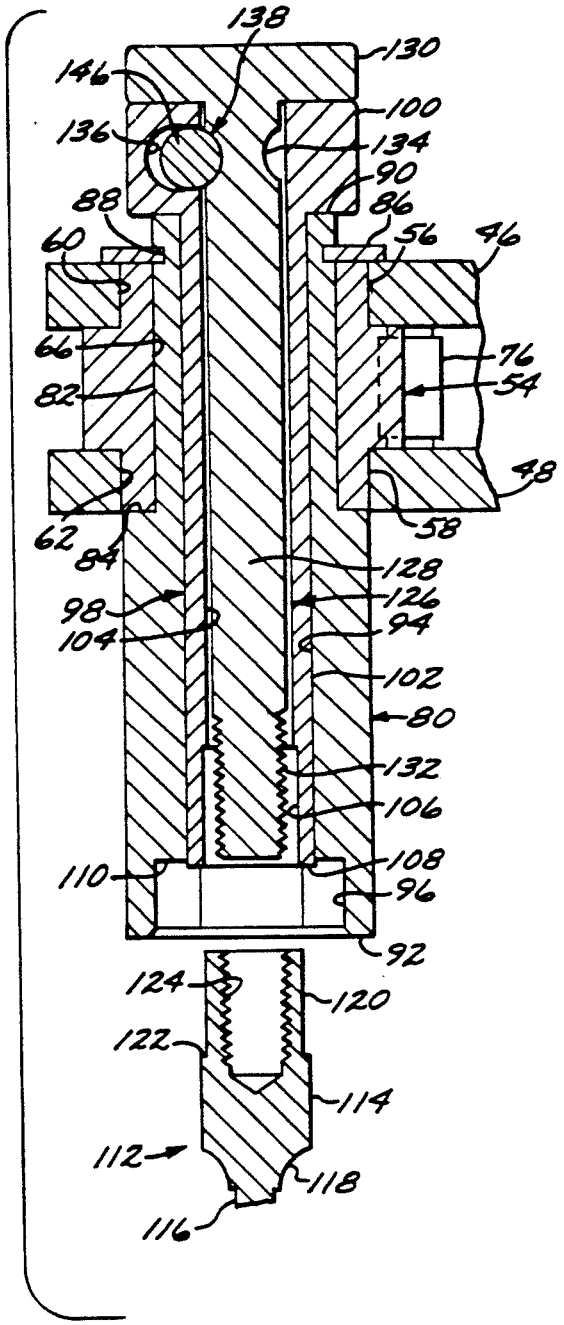
Figure 19:
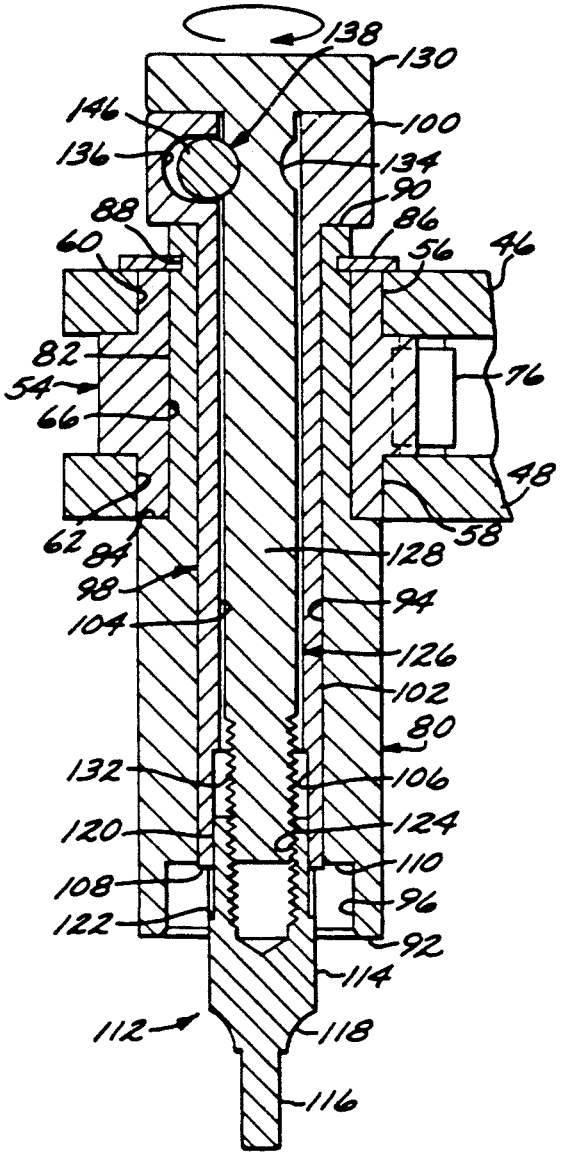
Figure 20:
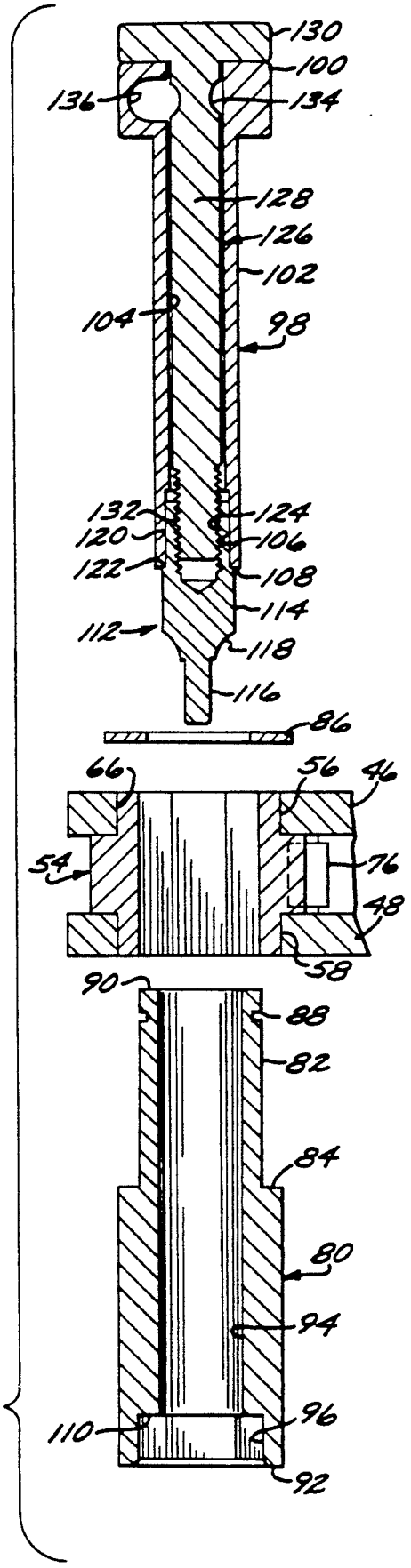
FIG. 20 is an axially exploded, vertical, axial section showing the parts of the invention also illustrated in FIGS. 6-19.
Figure 24:
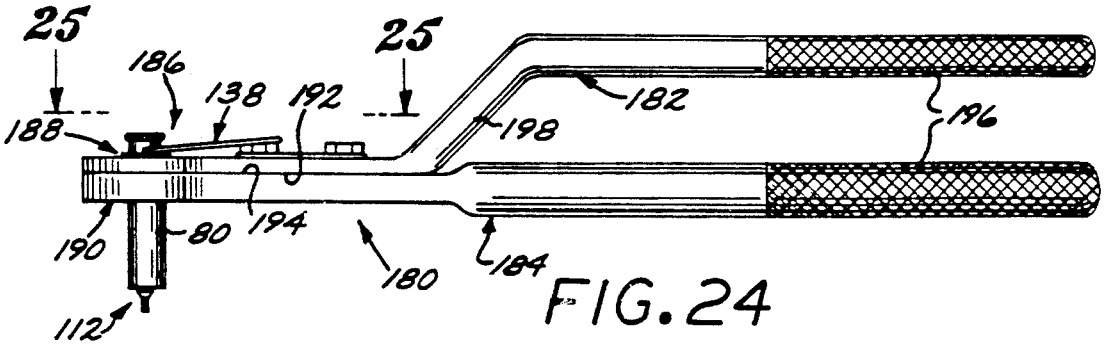
FIG. 24 is a side elevational view of a manual installation tool according to the invention.
Figure 25:
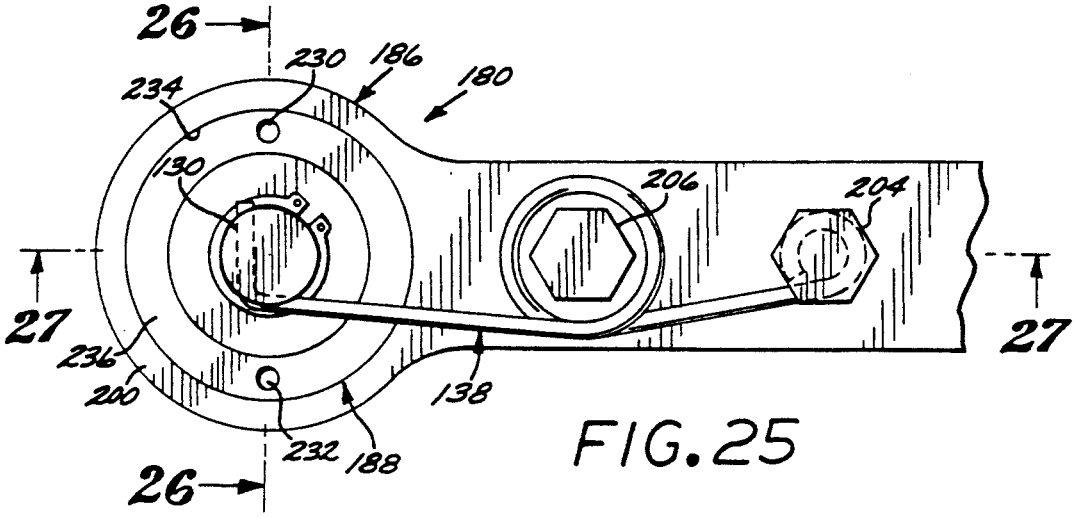
FIG. 25 is an enlarged, fragmentary top plan view taken on the line 25—25 in FIG. 24.
Figure 26:
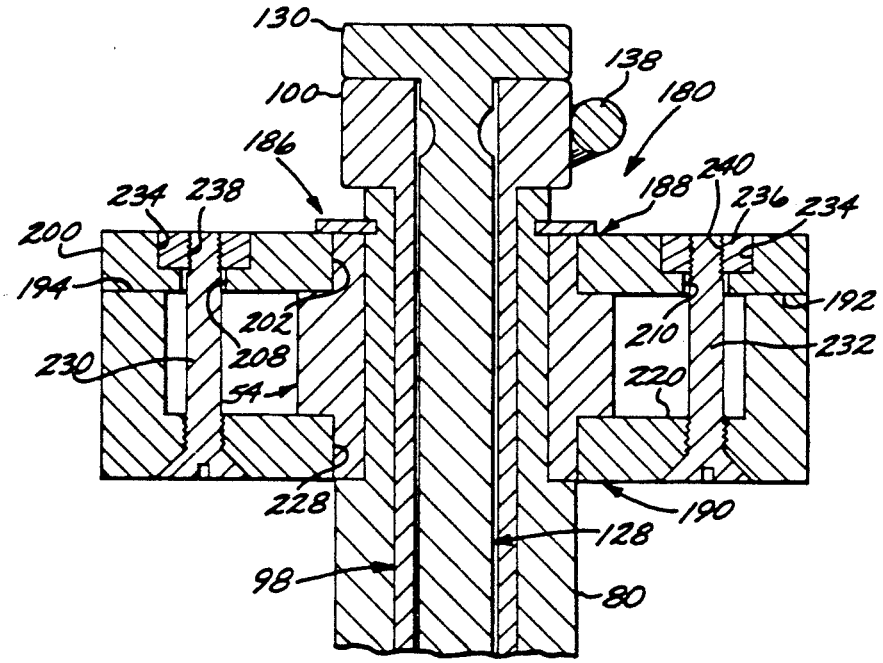
FIG. 26 is a further enlarged transverse, vertical section taken on the line 26—26 in FIG. 25.
Figure 27:
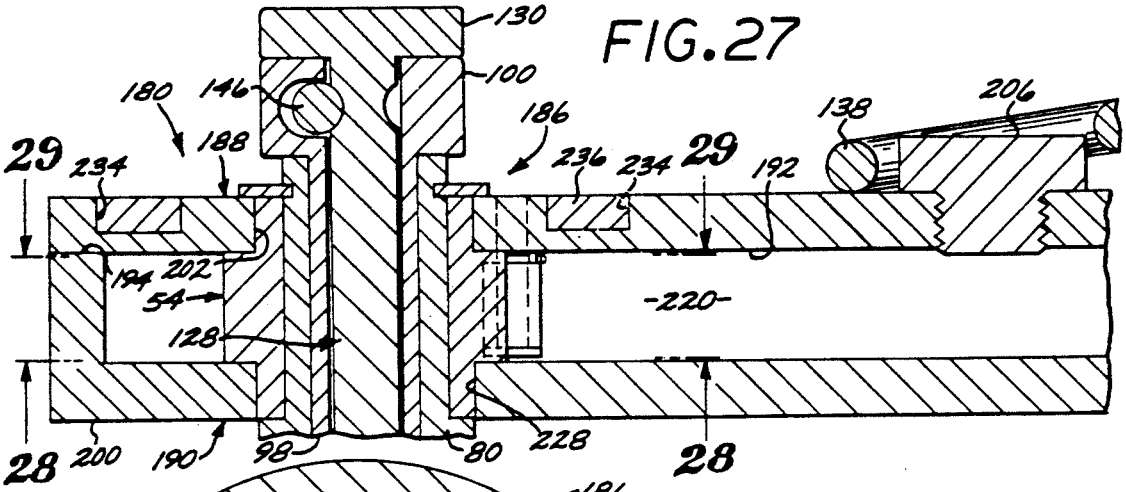
FIG. 27 is a similarly enlarged, fragmentary view taken on the line 27—27 in FIG. 25.
Figure 28:
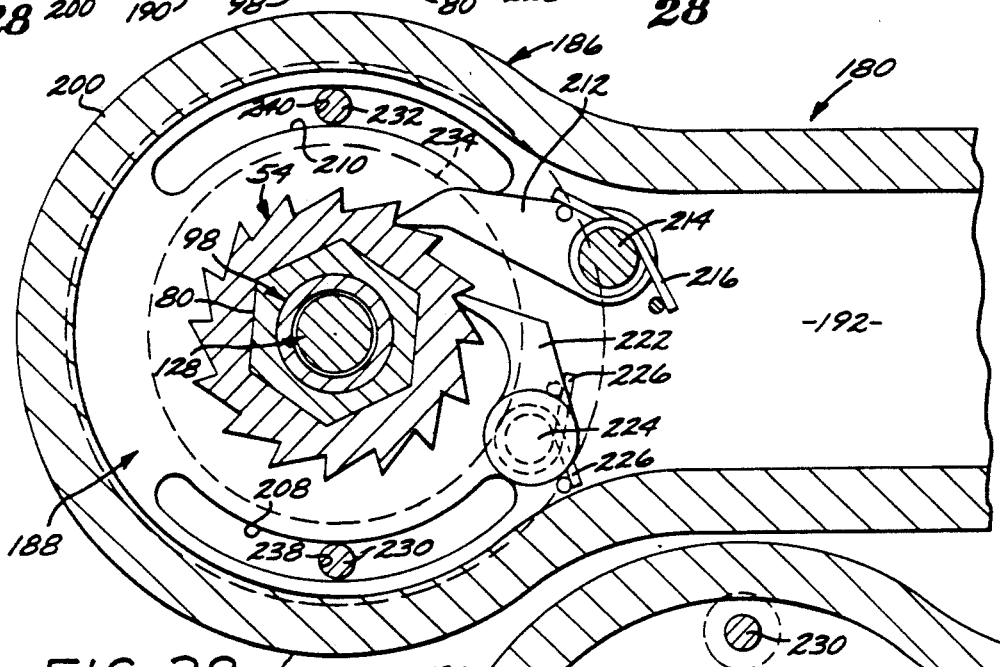
FIG. 28 is a fragmentary sectional view taken on the line 28—28 in FIG. 27.
Figure 29:
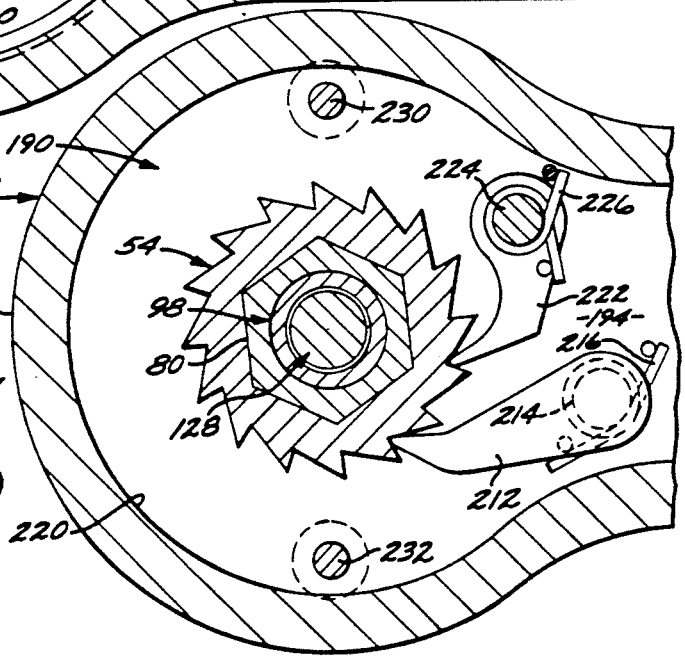
FIG. 29 is a fragmentary sectional view taken on the line 29—29 in FIG. 27.
Figure 30:
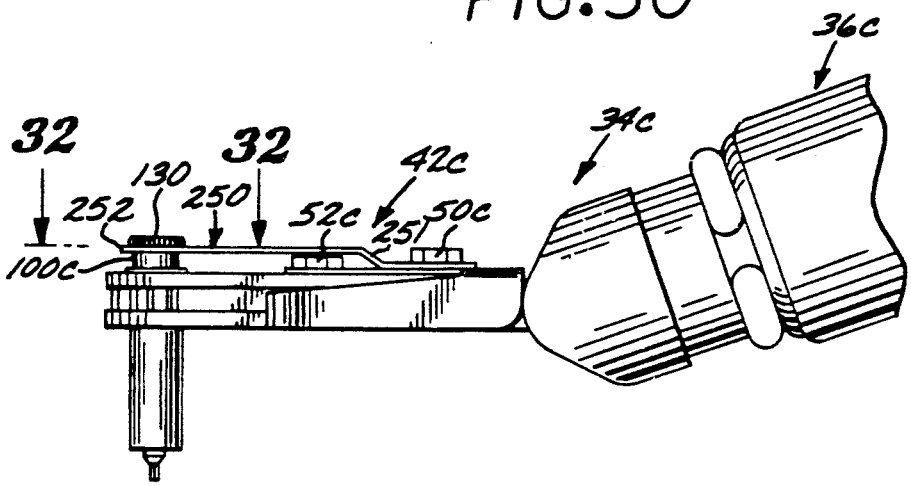
FIG. 30 is a fragmentary side elevational view illustrating a leaf spring form of the invention wherein the retention spring of the invention is a leaf spring, rather than the heavy wire spring shown in earlier forms of the invention.
Figure 31:
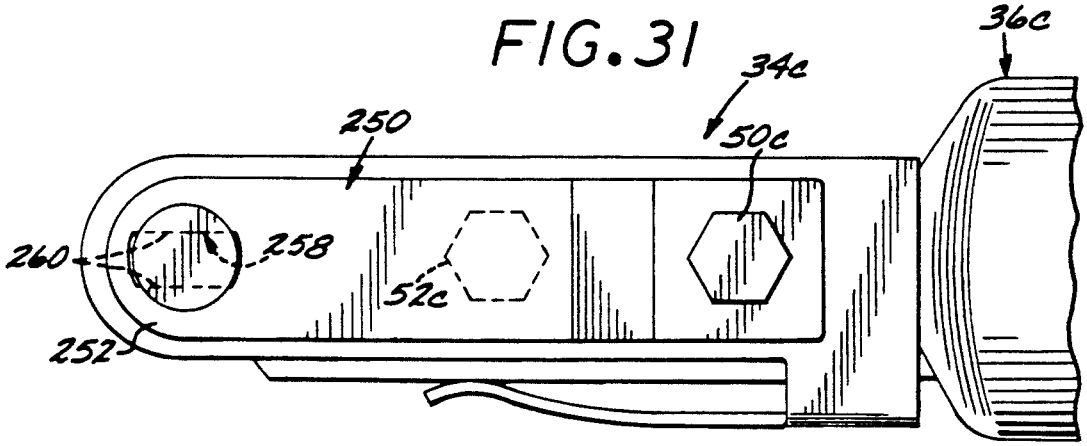
FIG. 31 is an enlarged, fragmentary top plan view of the leaf spring form of the invention shown in FIG. 30.
Figure 32:
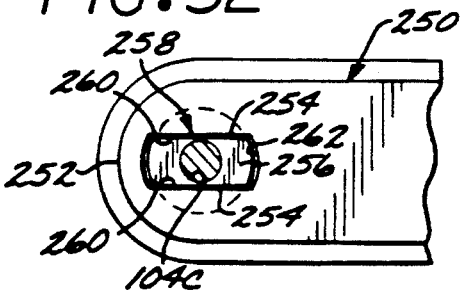
FIG. 32 is a fragmentary horizontal section taken on the line 32—32 in FIG. 30.
Figure 33:
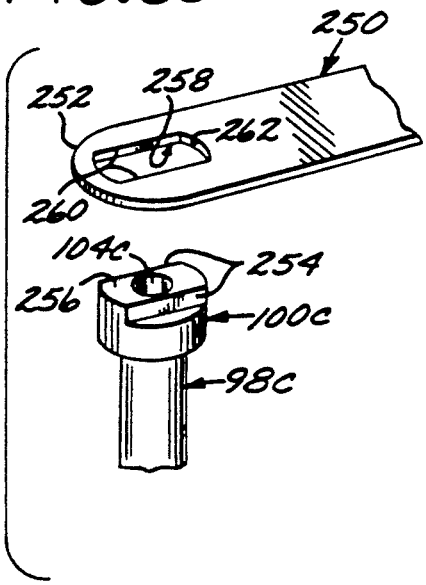
FIG. 33 is an enlarged, fragmentary, exploded perspective view illustrating the head portions of the leaf spring and key holder.

FIG. 17 shows hex key 112 in a partially ejected location, while FIG. 18 shows hex key 112 completely ejected from ratchet head assembly 42. As seen in FIG. 19, once the original hex key 112 has been thus ejected from ratchet head assembly 42, a new hex key 112 is quickly and easily assembled into ratchet head assembly 42 by simply aligning the external hex locator portion 120 of the new key 112 with the hex keyway 106 in key holder 98, and then manually rotating retention shaft head 130 clockwise as viewed in FIG. 5 to draw key 112 up into its seated position as seen in FIG. 6.

Flush Ratchet Head Assembly

Figure 10:
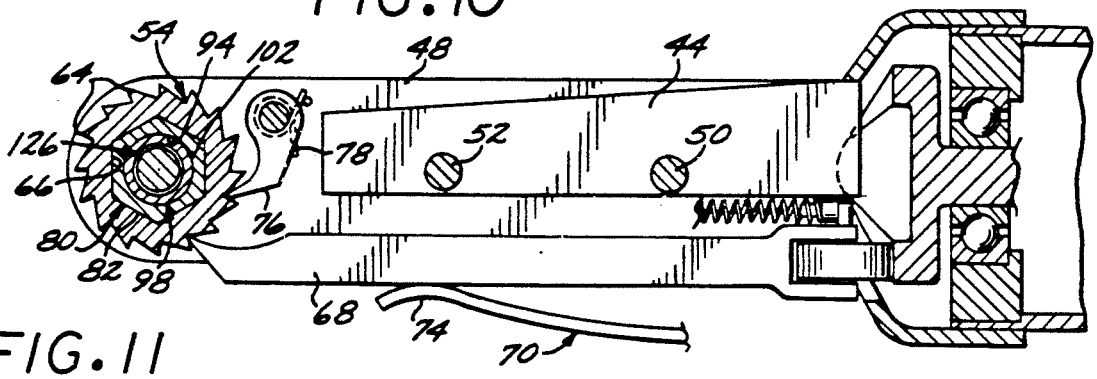
FIG. 10 is an enlarged, fragmentary sectional view, partly in elevation, taken on the line 10—10 in FIG. 4.
Figure 11:
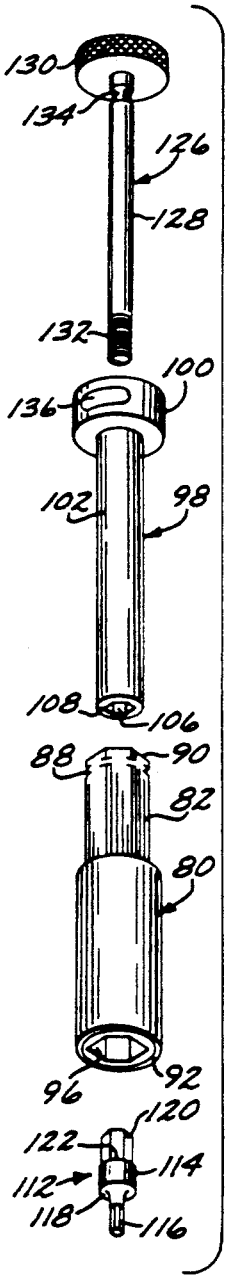
FIG. 11 is an axially exploded, enlarged perspective view illustrating principal components of the invention, including extended socket member, hex key, tubular key holder, and key retention shaft.

FIG. 21 illustrates a "flush" ratchet head assembly, generally designated **42*a*. In flush ratchet head assembly 42*a*, there is no extended socket like socket member 80 which projects forwardly from the bottom plate 48 of the assembly, but instead the torque-off nut drive socket is combined with the ratchet gear as a single integral unit. This ratchet gear/socket unit is generally designated 150, and consists principally of an annular barrel 152 which has external annular upper and lower pivot surfaces 154 and 156, respectively, which are journalled within the respective bores 60 and 62 in plates 46 and 48. Ratchet gear unit 150 has an integral ratchet drive flange 158 thereon with ratchet teeth arrayed as illustrated in FIG. 10, ratched drive flange 158 being disposed between head plates 46 and 48 so as to axially locate ratchet gear unit 150. Ratchet gear unit 150 has a cylindrical annular inner surface 160 which opens at its forward end into a forwardly facing hex drive socket recess 162 that is adapted to engage over and drive the torque-off drive nut part 26 of fastener 10. Ratchet gear unit 150 has a flat annular rear end surface 164**.

The cylindrical annular inner surface 160 of ratchet gear unit 150 serves as a guide for a shortened tubular key holder **98*a* which is identical to key holder 98 previously described, except for its shortened length. Thus, shortened key holder 98*a* has head portion 100*a* and a shortened barrel portion 102*a*, and a hexagonal keyway 106*a* in its forward end portion. Key retention shaft 126*a* is identical to key retention shaft 126 previously described, except for a shortened shaft portion 128*a*, and includes knurled head portion 130*a***.

Hex key 112 is threadedly connected to key retention shaft **126*a* as previously described, having external hex locator 120 received within the hexagonal keyway 106*a* of key holder 98*a*. Key holder 98*a* and the combination of retention shaft 126*a* and hex key 112 are held together as previously described by means of retention spring cross-head 146**.

The aforesaid construction of flush ratchet head assembly **42*a* enables the forward end 166 of ratchet gear unit 150 to be substantially flush with the bottom surface of lower head plate 48, providing the operational advantage of being adaptable for use in minimum clearance zones. Otherwise, flush ratchet head assembly 42*a* operates in the same manner as the extended socket type ratchet head assembly 42 previously described. Ratchet gear unit 150 is driven by the oscillating drive pawl 68 so as to drive its hex drive socket recess 162 during a fastener installation event, while the annular inner surface 160 of gear unit 150 and annular outer surface of barrel portion 102*a* of key holder 98*a* enable key holder 98*a*, retention shaft 126*a* and hex key 112 to be retained rotationally stationary by retainer spring cross-head 146, while retainer spring 138 enables holder 98*a*, retention shaft 126*a* and key 112** to shift rearwardly during an installation operation.

While flush ratchet head assembly **42*a* has the limited access advantage, it does not allow for interchangeability of socket members 80 of varying lengths. Thus, typically a separate installation tool 34 is normally kept available with an already-installed flush ratchet head assembly 42*a* of FIG. 21. Otherwise, it would be necessary to interchange between a ratchet drive gear 54 of the type previously described in connection with FIG. 1–20 and a ratchet gear unit 150 of FIG. 21 if the same overall installation tool 34 is to be employed. Such interchange is enabled by the fact that the same ratchet head plates 46 and 48 with the same pivot bores 60 and 62 therein are employed for both the ratchet drive gear 54 used with the extended socket members 80 and flush ratchet gear unit 150. It is to be noted that the number of parts is minimized in flush ratchet head assembly 42***a*, since ratchet gear unit 150 as a single unit serves the functions of both ratchet drive gear 54 and the extended socket member 80, and since there is no need in flush ratchet head assembly 42*a* for a spring clip 86 employed for retaining the extended socket member 80.

Alternative Hi-Lok Fastener Installation Tools Embodying the Invention

The present invention is suitable for use in any of the various overall installation tool configurations employed to install Hi-Lok-type fasteners. Although details of the invention have been shown and described hereinabove with respect to a 20° ratchet head installation tool, the invention is equally applicable to straight ratchet head installation tools, to a variety of geared L-head installation tools such as that illustrated in FIGS. 22 and 23, to a manual installation tool such as that illustrated in FIGS. 24–29, and to a variety of pistol grip straight drive installation tools such as that illustrated in FIGS. 35–58.

Geared L-Head Installation Tool

FIGS. 23 and 23 illustrate a geared L-head installation tool generally designated 34*b* in which the present invention is also embodied. L-head installation tool 34*b* has a pistol grip body 36*b* containing an air motor which is energized by means of an actuating finger trigger 40*b*. A support tube 170 is affixed at one end to body 36*b* and extends from body 36*b* to a free end upon which a geared L-head assembly 42*b* is supported. A drive shaft within support tube 170 is driven by the air motor in body 36*b* and drives a primary drive spur gear 172 within L-head assembly 42*b*. A series of laterally offsetting driven spur gears 74 is contained in geared L-head assembly 42*b* and drives socket drive gear 54*b* in the free end portion of L-head assembly 42*b*. The lateral length of L-head assembly 42*b* will vary for various fastener installation applications, and the number of laterally offsetting driven gears 174 will vary correspondingly. In the L-head assembly 42*b* shown in FIGS. 22 and 28, there are two offsetting spur gears, gear 174 and the spur gear and socket unit 54*b*. Socket drive gear 54*b* is identical to the ratchet gear and socket unit of FIG. 21, except for its conventional spur gear teeth 64*b*. In all other respects, the geared L-head assembly 42*b* is identical to ratchet head assembly 42*a* shown in FIG. 21 and described in detail in connection therewith.

Manual Installation Tool

FIGS. 24–29 illustrate a manually actuated fastener installation tool generally designated 180. Manual installation tool 180 utilizes the same basic tool elements as the air motor-powered tools 34, with its ratchet head assembly 42, the tool with a flush ratchet head assembly 42*a*, and the geared L-head-type installation tool 34*b*, including the same ratchet drive gear 54, extended socket members 80 or flush ratchet gear units 150, tubular key holders 98, hex keys 112, retention shafts 128, and retention spring 138. Manual installation tool 180 will be described as viewed in the drawings, although it is to be understood that it can be deployed in operation in any position. Tool 180 includes an upper lever arm 182 and a lower lever arm 184 which are pivotally connected relative to each other in a ratchet head assembly generally designated 186 in which lever arms 182 and 184 have generally flat, overlapping ratchet head portions 188 and 190, respectively. These ratchet head portions 188 and 190 of respective lever arms 182 and 184 have generally flat, elongated mating faces 192 and 194 which are arranged to angularly oscillate relative to each other when lever arms 182 and 184 are moved back and forth relative to each other during a fastener installation event. Each of lever arms 182 and 184 includes a handle extension 196 from its ratchet head portion 188 or 190, upper lever arm 182 having an angled spacer section 198 so that handle extensions 196 are spaced for convenience of manipulation.

Ratchet head portion 188 of upper lever arm 182 has a laterally enlarged, rounded head 200 with a generally centrally located bore 202 adapted for receiving ratchet gear pivot 56. A pair of screws 204 and 206 are threadedly engaged in upper ratchet head portion 188 for respectively securing and orienting retention spring 138. Screws 204 and 206 preferably do not extend below the lower, inner surface of upper arm ratchet head portion 188. A pair of arcuate slots 208 and 210 extend through upper arm head portion 200. Slots 208 and 210 are laterally placed and diametrically opposed, being concentric about the center of head bore 202. A socket-motivating pawl 212 is pivotally mounted on upper arm ratchet head portion 188 proximate its lower, inner surface on a pivot pin or screw 214, being biased against ratchet teeth 64 of ratchet drive gear 54 by means of a wire pawl biasing spring 216.

Lower lever arm ratchet head portion 190 also has a laterally enlarged, rounded head portion 218 which registers with head 200 of upper arm ratchet head portion 188. Lower arm ratchet head portion 190 is substantially thicker than upper ratchet head portion 188, and the laterally enlarged head 218 of lower head portion 190 is provided with an upwardly opening recess 220 which faces upper ratchet head portion 188. Recess 220 is rounded in the rounded head 218 of lower head portion 190 to provide space for a ratchet gear 54, and is elongated in the shank portion of lower ratchet head portion 190 to provide space for pawl 212, pivot pin 214, and pawl biasing spring 216. This recess 220 also accommodates a cog lever 222 pivoted on a pivot pin or screw 224 mounted on lower ratchet head 190, and a cog lever spring 226 mounted on lower ratchet head 190.

A pair of bolts 230 and 232 is threadedly secured in lower ratchet head 190, being laterally placed and diametrically opposed, and extending upwardly through the respective arcuate slots 208 and 210 of upper ratchet head 188. Bolts 230 and 232 are preferably of the flush head type, with their head surfaces flush with the lower surface of lower ratchet head 190 to accommodate a flush ratchet head assembly 42*a* when desired.

An upperwardly facing, flat-bottomed annular groove 234 in rounded head 200 of upper ratchet head portion 188 receives an annular nut ring 236 which has a pair of threaded bores 238 and 240 therethrough. Threaded bores 238 and 240 are diametrically disposed in nut ring 236, and bolts 230 and 232 are engaged therein to secure manual lever arms 182 and 184 against separation, while at the same time allowing for relative rotational ratcheting movement of arms 182 and 184 during a fastener installation event, with bolts 230 and 232 that are secured to lower arm ratchet head 190 moving back and forth through arcuate slots 208 and 210 of upper ratchet head 188. In this manner, bolts 230 and 232 relieve any undesired separation stress that might otherwise be applied to socket retainer spring clip 86 during operation of the tool.

In operation, the only difference between manual installation tool 180 and air motored-powered installation tool 34 is that in manual tool 180 socket member 80 (the extended socket member) or 54*a* (the flush socket member) is driven in manual installation tool 180 by oscillating its lever arms 182 and 184 back and forth relative to each other so as to advance the socket member relative to key holder 98, hex key 112, and retention shaft 126, with manual pawl 212 and cog lever 222 serving the same functions as the air motor-driven pawl 68 and cog lever 76.

Leaf Spring Form of the Invention

FIGS. 30–34 illustrate form 34*c* of the invention which embodies a leaf-type retention spring in place of the heavy wire retention spring 138. The leaf-type retention spring is desirable in high torque fastener installation situations where stiffer rotational resistance is necessary for hex key 112 than can be afforded by the wire-type retention spring 138.

The leaf-type retention spring is illustrated in connection with a 20° ratchet head installation tool 34*c* generally like the tool shown in FIGS. 4–20, which includes a tool body generally designated 36*c* and a 20° offset ratchet head assembly 42*c*. The generally flat, elongated leaf retention spring 250 overlies upper ratchet head plate 46, being generally parallel thereto, and being attached to upper plate 46 by means of bolt or screw 50*c* which extends through a hole in leaf spring 250 and clamps the rearward end (near body 36*c*) of spring 250 against the upper surface of upper plate 46. Spring 250 has an upwardly inclined jog 251 therein for spring 250 to clear the forward bolt 52*c* and for alignment of the free, forward end portion 252 of spring 250 with the head of a modified tubular key holder. The free, forward end 252 of leaf spring 250 is rounded similarly as the ratchet head plates 46 and 48, and generally overlies the modified tubular key holder 98*c*.

Key holder 98*c* has a head portion 100*c* which is milled at its top or rearward end to provide a pair of parallel, chordal flats 254 on opposite sides of holder bore 104*c*, so that holder head portion 100*c* has a generally oblong projection or island 256 that projects rearwardly or upwardly from the body of head 100*c* having parallel, flat, opposed sides and arcuate ends.

The rounded free forward end portion 252 of leaf spring 250 has an elongated slot 258 therethrough which is generally longitudinally arranged relative to elongated spring 250 and which generally registers in configuration and location with head projection 256, but is slightly larger in all dimensions than head projection 256 so as to allow a small amount of rotational play between key holder 98*c* and spring 250. Thus, leaf spring slot 258 has straight side edges 260 and arcuate end edges 262, whereby the free forward end of spring 250 is enabled to fit over the oblong head projection 256, with slot 258 generally registering with projection 256 so as to prevent rotation of key holder 98*c*, and hence also hex key 112 that is retained in key holder 98*c*. The slight oversize of spring slot or window 258 relative to holder projection or island 256 affords a small amount of rolling action of the key holder relative to leaf retention spring 250, and hence also head 34*c* of the tool, which tends to cushion hex key 112 in operation, and also enables key holder 98*c* and key 112 to be rotationally wiggled relative to tool 34*c* to facilitate rapid location of hex key 112 in wrench hex cavity 32 of the fastener 10.

Figure 34:
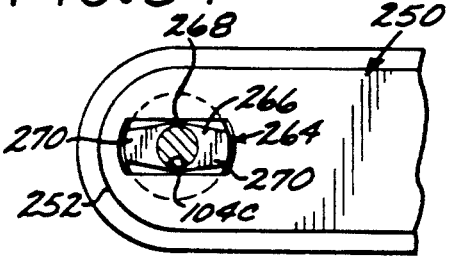
FIG. 34 is a view similar to FIG. 32, but illustrating a modified head portion of the key holder.

FIG. 34 illustrates a leaf spring form of the invention in which head 264 of tubular key holder 98*c* is modified in order to emphasize the aforesaid rolling action of hex key 112 relative to the ratchet head assembly 42*c* of the tool. In this alternative leaf spring form of the invention shown in FIG. 34, leaf spring 250 and its slot or window 258 are the same as in the form shown in FIGS. 31–33, but key holder 98*c* has a modified head 264 on which the milled oblong projection or island 266 tapers from being relatively wide proximate its longitudinal center 268 to being relatively narrower proximate its longitudinal ends 270.

Pistol Grip Straight Drive Installation Tool

Figure 35:
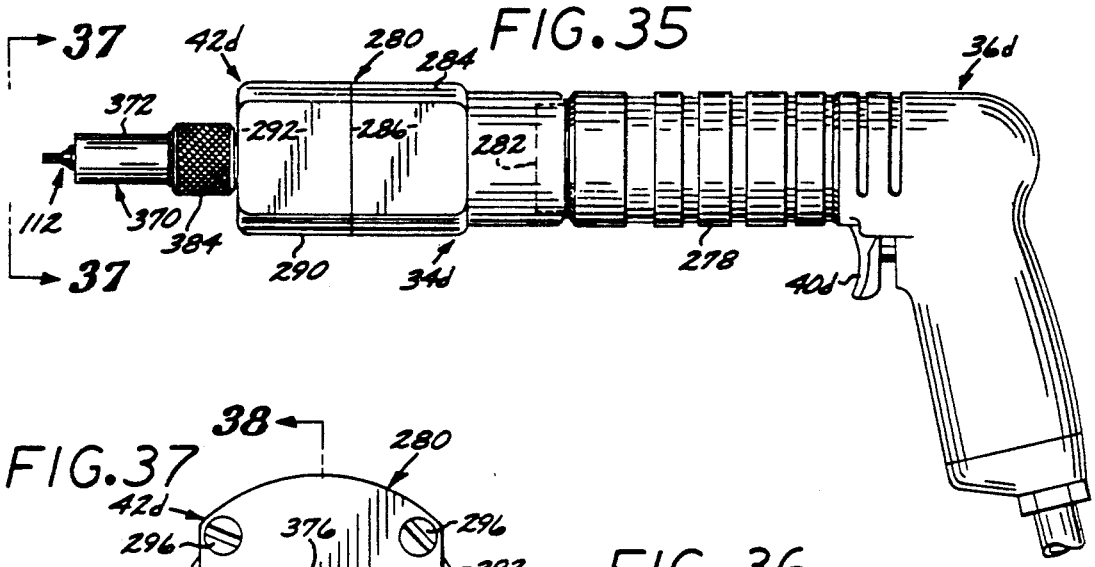
FIG. 35 is a side elevational view illustrating a pistol grip straight drive installation tool according to the invention.
Figure 37:
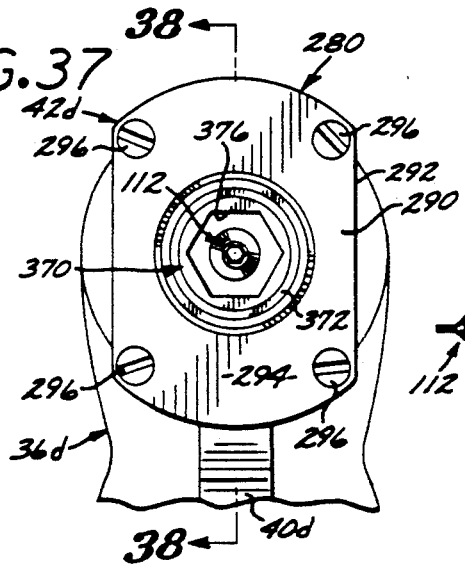
FIG. 37 is an enlarged, fragmentary front elevational taken on the line 37—37 in FIG. 35.

FIGS. 35–59 illustrate the details of construction and operation of a straight drive installation tool embodying the present invention which is generally designated 34*d*. Referring at first to FIG. 35, tool 34*d* has a pistol grip body 36*d* with an actuating finger trigger 40*d*. Body 36*d* includes an elongated barrel portion 278 which houses an air motor and which supports straight drive head assembly 42*d* at its forward end. Straight drive head 42*d* is elongated and generally coaxial with body barrel portion 278, and is connected to barrel portion 278 by means of a jam nut 282.

Figure 36:
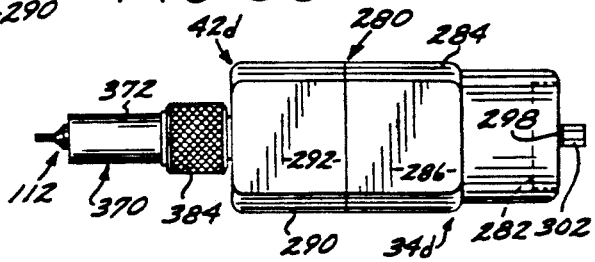
FIG. 36 is a side elevational view similar to FIG. 35, but showing only the straight drive head portion of the tool, separated from the pistol grip body of the tool.
Figure 38:
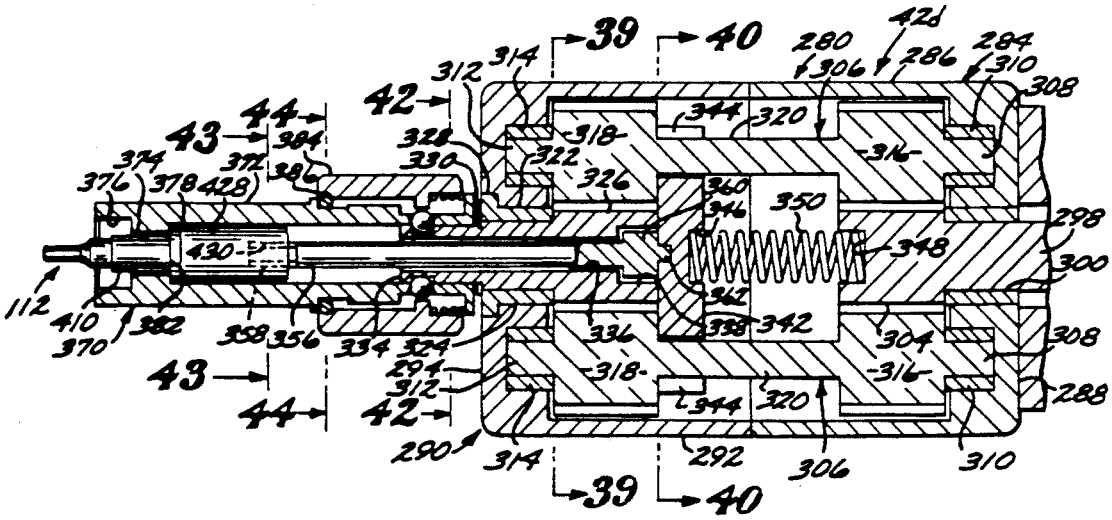
FIG. 38 is a fragmentary longitudinal, vertical section taken on the line 38—38 in FIG. 37, showing internal details of the straight drive head assembly of the installation tool shown in FIGS. 35-37.
Figure 39:
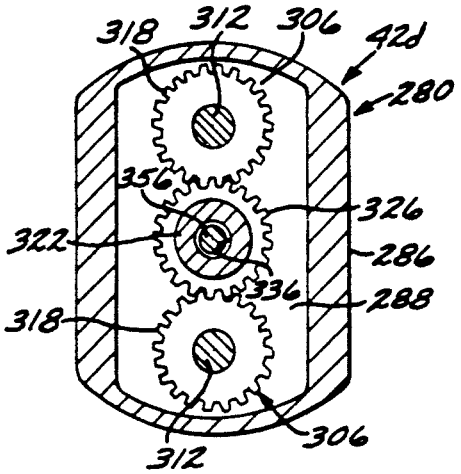
FIG. 39 is a transverse vertical section taken on the line 39—39 in FIG. 38.
Figure 40:
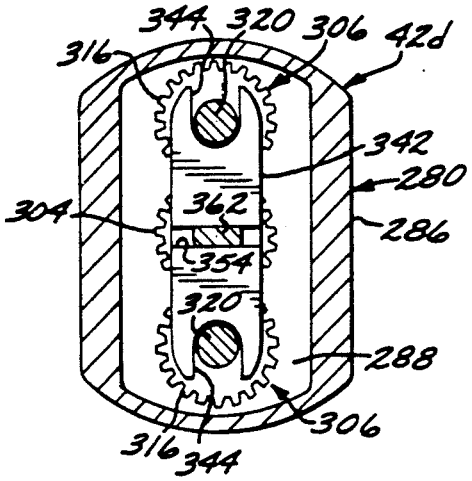
FIG. 40 is a transverse vertical section, partly in elevation, taken on the line 40—40 in FIG. 38.
Figure 41:
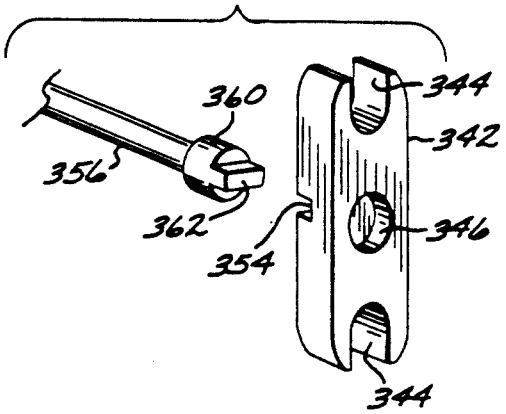
FIG. 41 is a fragmentary exploded view illustrating floating guide plate and extension rod elements within the straight drive head assembly shown in FIG. 38.
Figure 42:
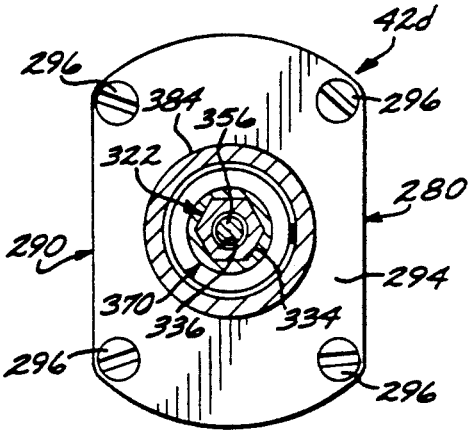
FIG. 42 is a transverse, vertical section, partly in elevation, taken on the line 42—42 in FIG. 38.
Figure 43:
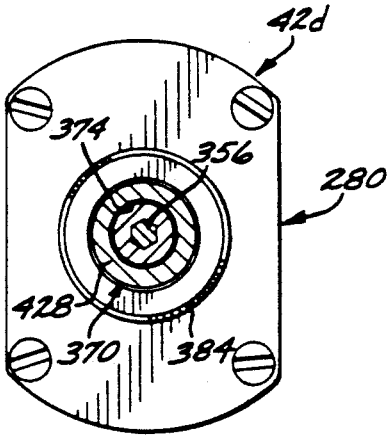
FIG. 43 is a transverse, vertical section, partly in elevation, taken on the line 43—43 in FIG. 38.
Figure 44:
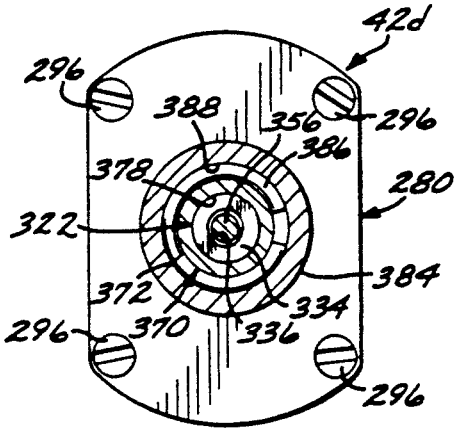
FIG. 44 is a transverse, vertical section, partly in elevation, taken on the line 44—44 in FIG. 38.

Housing 280 is seen in side elevation in FIGS. 35 and 36, in end elevation in FIGS. 37 and 42–44, in generally axial, vertical section in FIGS. 38 and 45–57, and in transverse section in FIGS. 39 and 40. Housing 280 includes a rear housing section 284 having a cylindrical, axially oriented wall 286 consisting of generally flat sides and upper and lower arcuate portions. Rear housing section 284 also includes an integral rear wall 288 from which axial wall 286 extends forwardly. A front housing section 290 is essentially a mirror image of rear housing section 288, and includes a cylindrical axial wall 292 having side flats and upper and lower arcuate sections, closed at its front end by means of an integral front wall 294. Four long screws or bolts 296 clamp housing sections 284 and 290 together with their respective cylindrical axial walls 286 and 292 in end-to-end abutment.

A rotary power input drive shaft 298 is rotatably mounted in a bearing sleeve 300 in housing rear wall 288. As seen in FIG. 36, power input drive shaft 298 has a power input hex 302 thereon which projects rearwardly from rear housing wall 288 to be driven by a mating output drive hex in the front end of the elongated barrel portion 278 of pistol grip body 36*d*. Power input drive shaft 298 has a spur drive gear 304 on its forward end just forward of rear housing wall 288.

A pair of elongated, axially oriented, generally parallel, spaced rotary power transfer gear units 306 is disposed in the upper and lower portions of housing 280. Each of the power transfer gear units 306 has a rearward end pivot 308 journalled in a bearing sleeve 310 within rear housing wall 288, and a front end pivot 312 journalled in a bearing sleeve 314 in front housing wall 294. Each of power transfer gear units 306 includes a rear driven spur gear 316 proximate rear housing wall 288, and a front drive spur gear 316 proximate forward housing wall 284. The rear, driven spur gears 316 of power transfer gear units 306 both mesh with and are rotatively driven by power input spur drive gear 304. Spur gears 316 and 318 of each power transfer gear unit 306 are axially spaced apart by an integral intermediate drive shaft 320.

A tubular rotary power output drive shaft 322 is journalled in a bearing sleeve 324 in front housing wall 294, power output drive shaft 322 having a driven spur gear 326 at its rear end which meshes with and is driven by both of the front power transfer drive spur gears 318. Drive shaft 322 extends from its driven spur gear 326 forwardly through bearing sleeve 324 and then extends forwardly of front housing wall 294 in a forwardly protruding portion adapted for rotatively driving the socket member of the tool. Drive shaft 322 cannot escape forwardly from housing 280 because of engagement of the root portion of its spur gear 326 against the inner end of bearing sleeve 324. Likewise, drive shaft 322 cannot move inwardly of housing 280 because of an out-turned forward flange 328 on bearing sleeve 324 and a snap ring 330 on drive shaft 322 which is shouldered against the front end of bearing sleeve 324. The forwardly protruding end portion of drive shaft 322 is generally designated 334, and embodies an external hex for driving the socket member of the tool.

Power output drive shaft 322 has a cylindrical bore 336 extending axially through its length, bore 336 having a short rearwardly opening counterbore 338 therein. The forwardly protruding end portion 334 of drive shaft 322 has an external annular groove 340 therein as best seen in the greatly enlarged views of FIGS. 48 and 49, but also seen in FIGS. 38 and 45–47. This groove 340 is part of a quick-release system for the socket member to be described in detail hereinafter.

An oblong floating guide plate 342 is arranged generally upright within housing 280, normally immediately to the rear of the front power transfer drive spur gears 318. Floating guide plate 322 has upper and lower end grooves 344 which fit over the respective power transfer drive shafts 320 as best seen in FIG. 40, but also seen in FIGS. 38 and 45–47. With this mounting of floating guide plate 342, it is free to move or float axially within housing 280, but is restrained by transfer shafts 320 against rotation. Floating guide plate 342 has a central rearwardly opening cupped recess 346 therein, and there is an opposed central forwardly opening cupped recess 348 in the forward end of rotary power input drive shaft 298. A helical compression spring 350 is engaged at its opposite ends within these cupped recesses 346 and 348 so as to bias floating guide plate 342 forwardly within housing 280. Floating guide plate 342 also has a forwardly opening transverse central slot 354 therein.

An extension rod 356 extends coaxially through the extent of bore 336 through output drive shaft 322, and extends substantially forwardly of drive shaft 322 within the socket member of the tool, terminating at its forward end in an external hex 358 for securing the hex key holder of the tool against rotation and for biasing the holder and key forwardly. Extension rod 356 has an annular head 360 at its rear end which lies within the rearwardly opening counterbore 338 of axial bore 336 in drive shaft 322. This extension rod head 360 has a rearwardly projecting cross-rib 362 therein which is engaged within floating guide plate transverse slot 354 for restraining extension rod 356 against rotation despite rotation of power output drive shaft 322.

The Socket Member of Straight Drive Installation Tool 34*d*

The socket member of tool 34*d* is generally designated 370, and consists of two principal parts, an elongated tubular body 372 and an external quick-release sleeve 384. Tubular body 372 has a through bore 374 with a forwardly opening, bevelled hex drive recess 376. As best seen in the greatly enlarged views of FIGS. 48–50, through bore 374 has a long rearward counterbore 378 which has a rearwardly opening internal hex driven portion 380 which fits over and is driven by the forwardly protruding external hex 334 on power output drive shaft 322.

External quick-release sleeve 384 is axially slideably mounted over socket body 372 by means of a split spring ring 386 captured within an internal groove 388 at the forward end of quick-release sleeve 384. An aperture in the front end of sleeve 384 (not shown) enables spring ring 386 to be snaked into its position within the sleeve internal groove 388. Ring 386 rides in an external annular groove 390 on socket body 372, this annular groove 390 determining the axial limits of travel of quick-release sleeve 384.

Quick-release sleeve 384 has an internal annular flange or rib 394 which cooperates with a pair of ball detents in the quick-release function. There is a rearwardly opening bore 396 in quick-release sleeve 384 behind internal flange or rib 394. Socket body 372 has a reduced annular rearward portion 398 which ends in an external annular flange 400 at the rear end of socket body 372. Flange 400 is slightly smaller in diameter than rearwardly opening bore 396 of sleeve 384 because flange 400 enters bore 39*b* during actuation of sleeve 384. A helical compression spring 402 lies within rearwardly opening bore 396 and is engaged against sleeve flange 394 and body flange 400 so as to bias quick-release sleeve 384 forwardly to its normal position of repose, which is the position shown in FIGS. 38, 45–47, 48 and 50.

Figure 48:
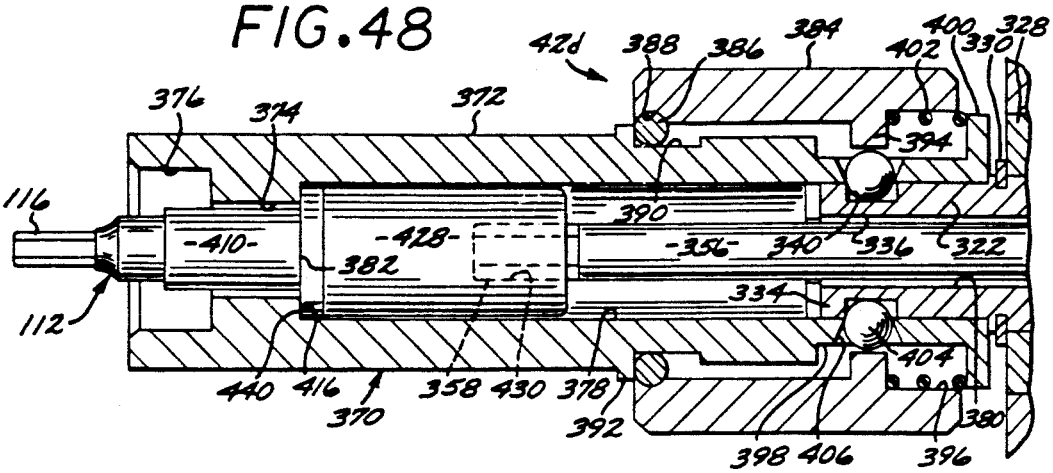
FIGS. 48-50 are fragmentary longitudinal vertical sections, partly in elevation, showing a sequence in which the socket member of the tool is disengaged from the output drive shaft of the tool, FIG. 50 showing the socket member completely disengaged, and also showing the assembly of hex key holder, hex key, retention shaft, and connector tube being removed rearwardly from the socket member after removal of the socket member from the drive shaft.
Figure 49:
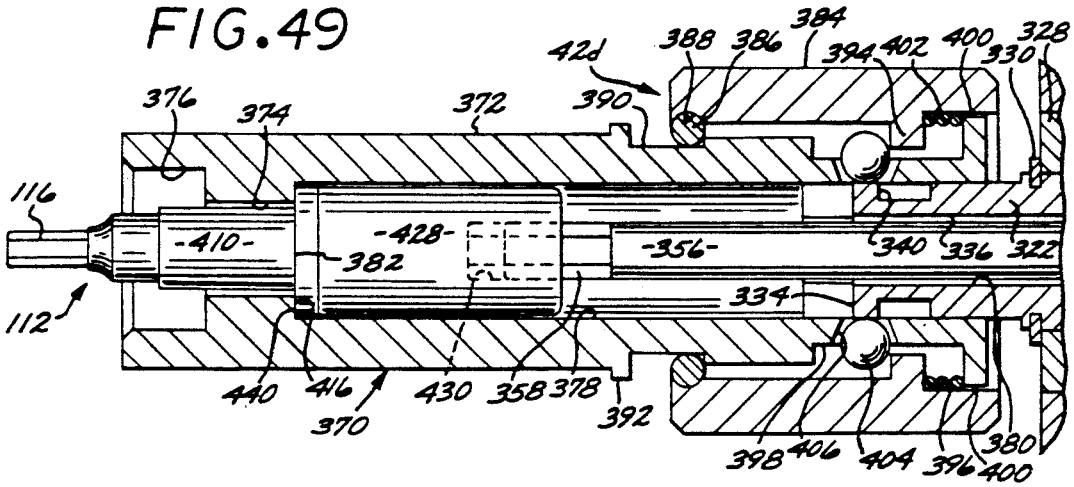
Figure 50:
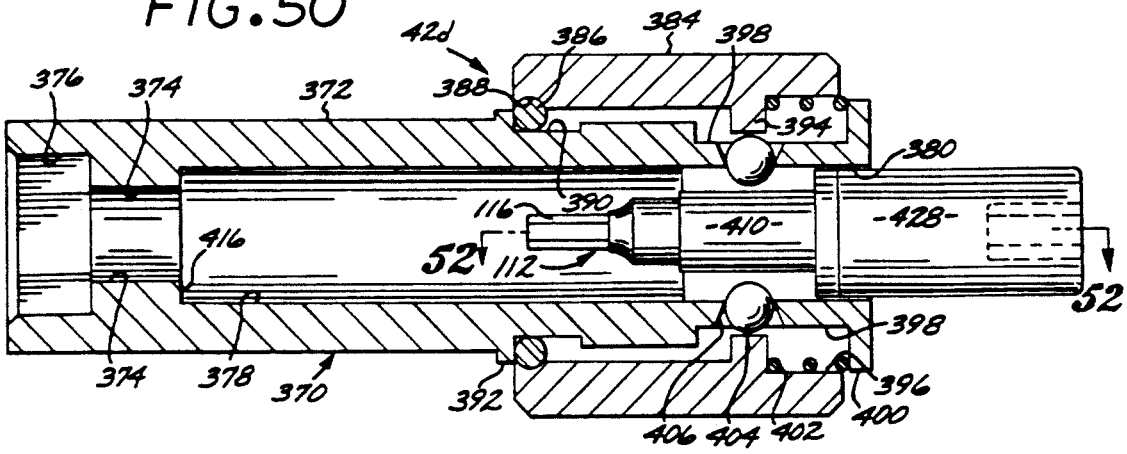

A pair of ball detents 404 is floatingly disposed in a pair of frustoconical recesses 406 which extend generally radially through the wall of the reduced rearward portion 398 of socket body 372. These frustoconical recesses 406 are radially outwardly opening, and are diametrically opposed. FIGS. 48–50 illustrate the mode of operation of quick-release sleeve 384 from a positively locked location of socket body 372 on the forwardly protruding end portion 334 of power output drive shaft 322 in FIG. 48, to a fully released position of socket body 372 completely free of end portion 334 of drive shaft 322 in FIG. 50. In FIG. 48, quick-release sleeve 384 is biased to its forwardmost position on socket body 372 by spring 402. In this position, split ring 386 seats against the forward end of annular groove 390, and sleeve flange or rib 394 locks ball detents 404 within external annular groove 340 on drive shaft end portion 334. In FIG. 49, quick-release sleeve 384 has been pulled to its rearwardmost position on socket body 372 against the compression force of spring 402. In this position, ring 386 abuts against the rear end of body groove 390, and internal flange or rib 394 in quick-release sleeve 384 lies to the rear of ball detents 404, freeing balls 404 to move radially outwardly from external groove 340 on drive shaft forward portion 334, thus enabling socket body 372 to be slid forwardly off of forward portion 334 of drive shaft 322 to a freed position as shown in FIG. 50.

The Assembly of Hex Key Holder, Hex Key, Retention Shaft, and Connector Tube The assembly of hex key holder, hex key, retention shaft, and connector tube is, as a whole, generally designated 408, and its details are best seen in FIGS. 51–59. Assembly 408 is seen operatively disposed within socket body 372 in FIGS. 38 and 45–49.

The tubular key holder is designated 410, and has a through bore 412 with a forwardly opening internal hex 414 to receive the external hex locator portion 120 of the rearward body portion 114 of hex key 112. It is to be noted that the same hex key 112 is employed in the straight drive installation tool **34*d* as described above in detail in connection with the form of the invention shown in FIGS. 4–20. Key holder 410 has an external annular flange 416 generally midway along its length, and has a hex head 418 at its rear end. Key retention shaft 420 includes an elongated annular shaft portion 422, an externally threaded forward end portion 424 for threaded engagement within the threaded key bore 124, and it also has a hex head 426 at its rear end which has the same radial external dimensions as key holder hex head 418, but lies rearwardly of head 418**.

A tubular connector 428 is provided which has a rearwardly opening hex socket 430. This rearwardly opening internal hex 430 of connector 428 is engaged by external hex 358 on extension rod 356 to restrain connector 428 against rotation during fastener installation events, and also to bias assembly 408 to a forwardmost location within socket body 372. Connector 428 has a forwardly opening bore 432, with a solid web 434 between bores 430 and 432. Forward bore 432 has an annular forward portion 436 and a rearward hex portion 438, the dotted line 439 seen in FIGS. 52, 55 and 59 indicating the axial juncture between the annular forward bore portion 436 and the hex rearward bore portion 438. The angle apexes of hex rearward bore portion 438 preferably have the same diameter as annular forward bore portion 436. Tubular connector 428 has a forward end 440 which stops against the external annular flange 416 of key holder 410 during fastener installation events. A split spring stop ring 442 is located in an internal annular recess near the forward end of forwardly opening bore 432.

Figure 45:
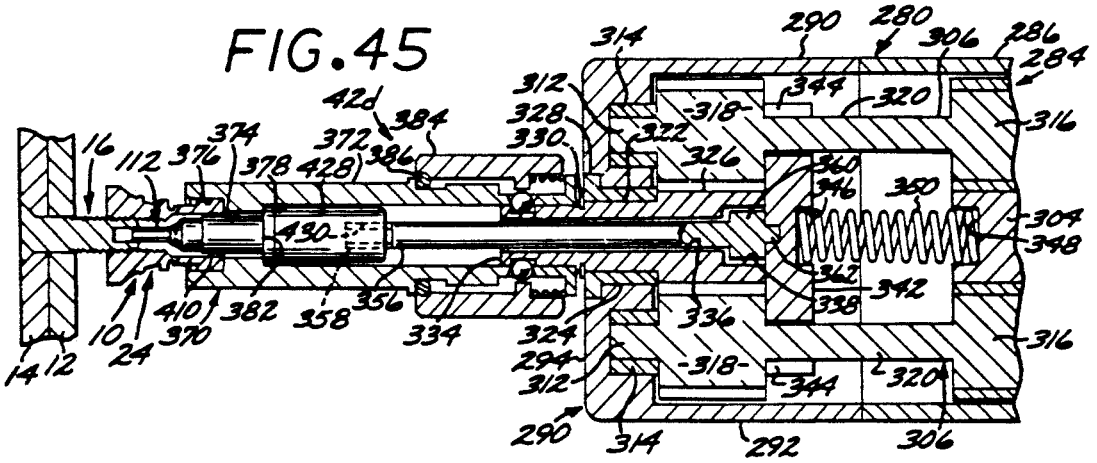
FIGS. 45-47 are fragmentary longitudinal vertical sections, with portions in elevation, illustrating a Hi-Lok fastener installation sequence performed by the pistol grip straight drive installation tool shown in FIGS. 35-44.

The normal position of repose of tubular connector 428 in the tool is best illustrated in FIG. 48. In this position, hex end 358 on extension rod 356 is fully seated in the rearwardly opening hex recess 430 of connector 428. The forward end of extension rod 356 biases tubular connector 428 to a forwardmost position in socket body 372, this forward biasing force being applied by helical compression spring 350 as seen in FIGS. 38 and 45–47. Forward end 440 of connector 428 in turn abuts against external flange 416 on key holder 410 which is stopped against rearwardly facing shoulder 382 within socket body 372. This same forward axial location of tubular connector 428 within socket body 372 is also illustrated in FIGS. 45 and 47.

Fastener Installation Sequence

Figure 46:
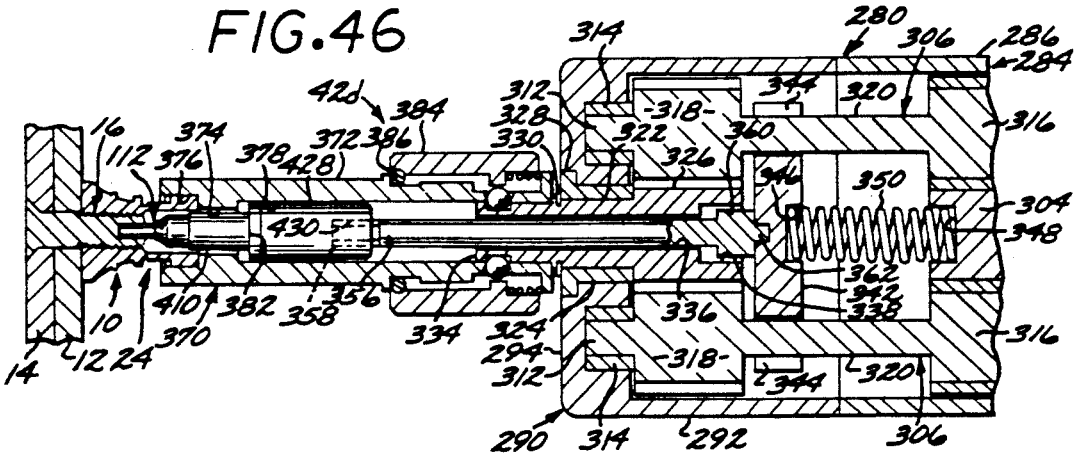
Figure 47:
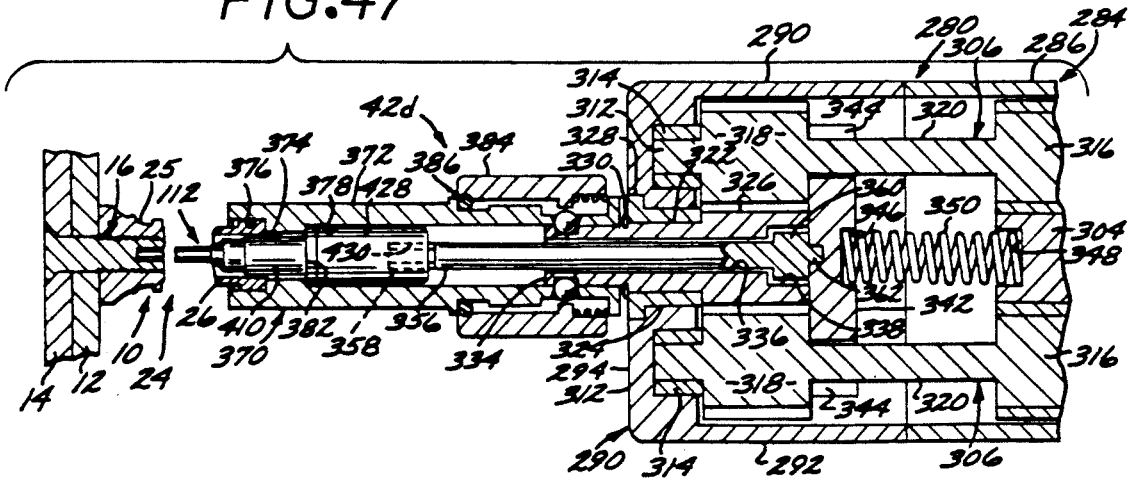

FIGS. 45–47 illustrate a fastener installation sequence wherein the straight drive installation tool **34*d* is employed to install a frangible fastener 10 of the Hi-Lok type. First, as shown in FIG. 45, body portion 25 of collar component 24 is threaded a few turns unto the threaded end portion 22 of pin component 16 after pin component 16 has been inserted through hole 15 in workpieces 12 and 14. Then the forwardly opening bevelled hex drive 376 on socket body 372 is engaged over the torque-off drive nut portion 26 of collar component 24, while at the same time the hex torquing portion 116 of hex key 112 is inserted within hex wrench cavity 32 in pin component 16. Then the air motor in tool body 36*d* is energized by actuating finger trigger 40*d*, in turn applying rotary power to input drive shaft 298 of the straight drive head assembly 42*d*. This rotationally motivates rearward spur drive gear 304, which in turn rotates the upper and lower power transfer gear units 306 which rotationally drive the driven spur gear 326 on the rear end of rotary power output drive shaft 322. Drive shaft 322 rotates socket member 370 by engagement of the forwardly protruding drive shaft hex 334 within the rearward hex 380 of socket body 372. This rotation of socket body 372 runs the threaded body portion 25 of collar component 24 down onto the threaded portion of pin 16 from the starting position of FIG. 45 to the clamping position against workpieces 12 and 14 shown in FIG. 46**.

During this rotation of socket body 372 and hence collar body 25, pin component 16 is restrained against rotation by engagement of hex key torquing projection 116 within hex cavity 32 in pin component 16. The manner in which hex key 112 is restrained against rotation will now be described in a rearward-to-forward direction in straight drive head assembly **42*d*. First, floating guide plate 342 is restrained against rotation by engagement of its end grooves 344 over the respective intermediate drive shafts 320 of power transfer gear units 306. Next, extension rod 356 is restrained against rotation by floating guide plate 342 because of engagement of the rearwardly projecting cross-rib 362 on the rear end of extension rod 356 within forwardly opening transverse slot 354 in floating guide plate 342, such engagement being assured by the compression force of helical spring 350. Next, tubular connector 428 is restrained against rotation by extension rod 356 because of engagement of the external front end hex 358 on rod 356 within the rearwardly opening hex 430 in tubular connector 428**.

Figures 51, 52, 53, 54, 55:
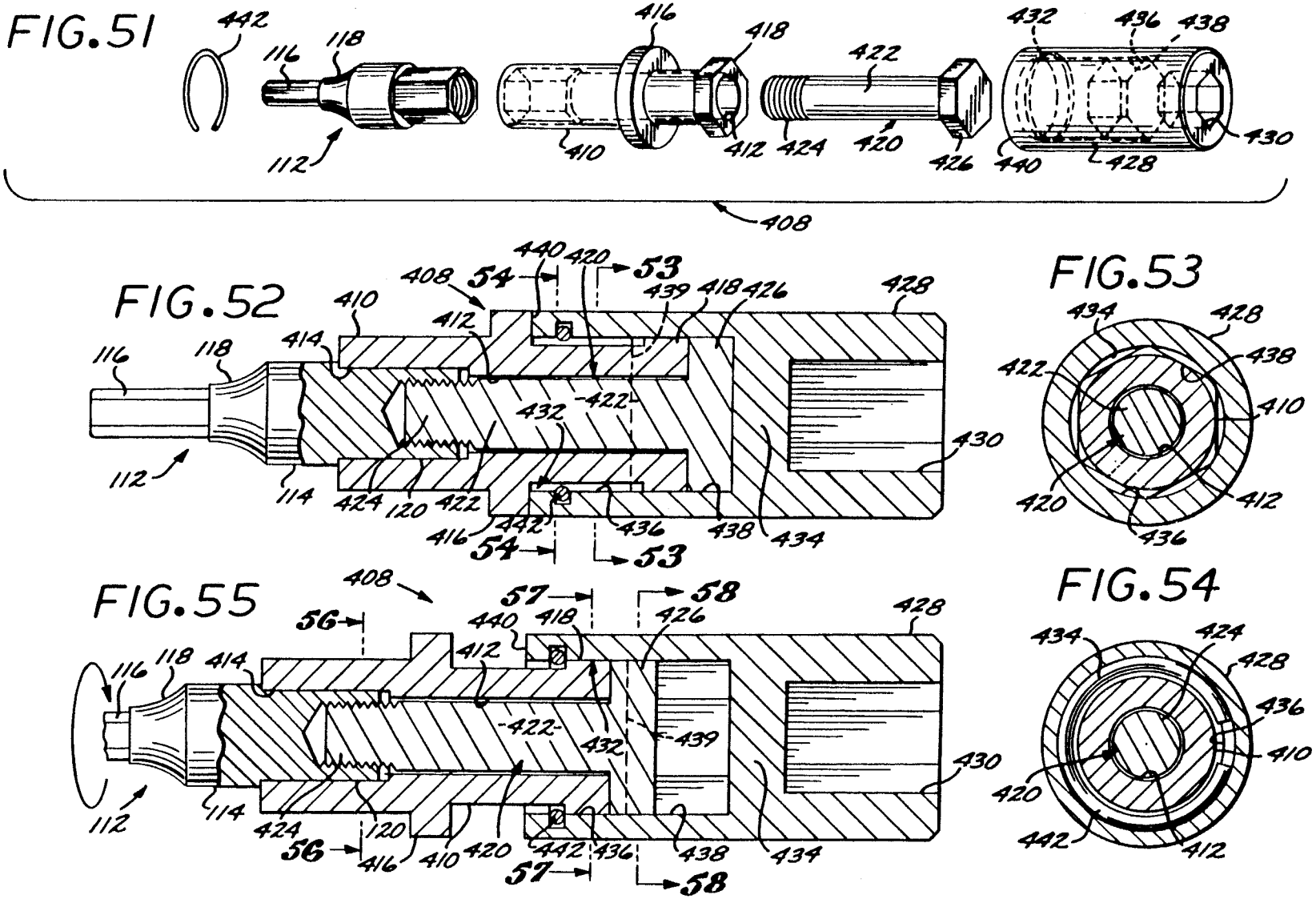
FIG. 51 is an axially exploded perspective view illustrating the assembly of hex key holder, hex key, retention shaft, and connector tube, as well as a retainer ring embodied in this assembly.
FIG. 52 is a longitudinal sectional view, partly in elevation, illustrating this assembly in its axially collapsed, normal operative condition.
FIG. 53 is a transverse section taken on the line 53—53 in FIG. 52.
FIG. 54 is a transverse section taken on the line 54—54 in FIG. 52.
FIG. 55 is an axial section, partly in elevation, showing this assembly in its fully extended condition for ejection of the hex key from the assembly.
Figure 58:
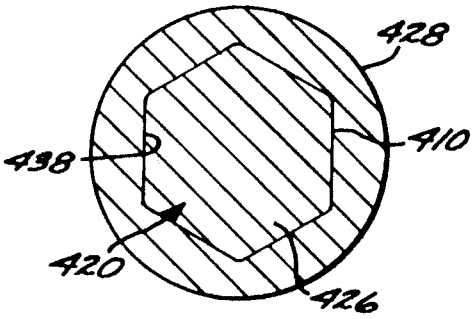
FIG. 58 is a transverse section taken on the line 58—58 in FIG. 55.
Figure 57:
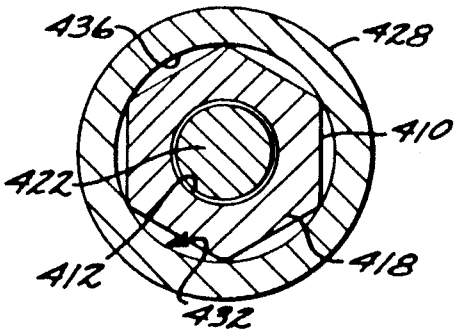
FIG. 57 is a transverse section taken on the line 57—57 in FIG. 55.
Figure 56:
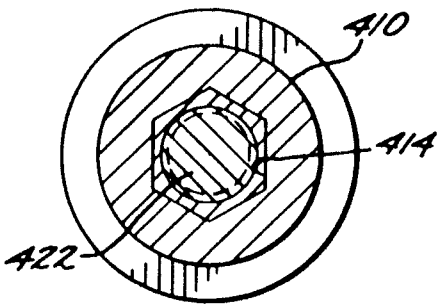
FIG. 56 is a transverse section taken on the line 56—56 in FIG. 55.

Continuing this sequence for restraining hex key 112 against rotation during an installation event with reference to FIG. 52, as aforesaid, the forward biasing force of extension rod 356 against tubular connector 428 causes connector 428 to move to a forwardmost position wherein its forward end 440 abuts against external flange 416 on key holder 410. This places key holder hex head 418 within the internal hex portion 438 of the forwardly opening bore 432 in connector 428. This hex connection between key holder hex head 418 and the rearward hex portion 438 of bore 432 causes the nonrotating connector 428 to restrain key holder 410 against rotation. Hex key 112 is then restrained against rotation by engagement of its rearward external hex locator portion 120 within the forwardly opening hex recess 414 in key holder 410. Hex key 112 is maintained thus fully seated within the forward end portion of key holder 410 by threaded engagement of the threaded forward end portion 424 of retention shaft 420 in the rearwardly opening threaded bore 124 of hex key 112.

Referring again to FIG. 46, as socket body 372 runs collar body 25 down onto pin 16, socket body 372 moves axially forwardly relative to hex key 112. Since socket body 372 is axially fixed relative to the remainder of the installation tool 34*d* through ball detents 404, including drive head assembly 42*d*, the entire sequence of parts described above for holding hex key 112 against rotation is, in effect, shifted rearwardly relative to drive head assembly 42*d* to a rearwardly displaced location as illustrated in FIG. 46. The axial floating action of guide plate 342 against compression spring 350 enables such relative rearward displacement of extension rod 356, tubular connector 428, key holder 410, and hex key 112 and its retention shaft 420. The retractability of key 112 enabled by floating guide plate 342 also has the advantage of accommodating tolerance variations in the heights of various Hi-Lok-type frangible fasteners 10.

Socket body 372 continues to be rotatively driven until preload breakoff of the torque-off drive nut portion 26 of collar component 24, at which time tool 34*d* is backed off from installed combination of pin component 16 and body portion 25 of collar component 24, as illustrated in FIG. 47. At this time, compression spring 350 returns floating guide plate 342 and the other nonrotating portions of the drive head assembly 42*d* to their initial positions as shown in FIG. 45.

Hex Key Ejection and Replacement

Figure 59:
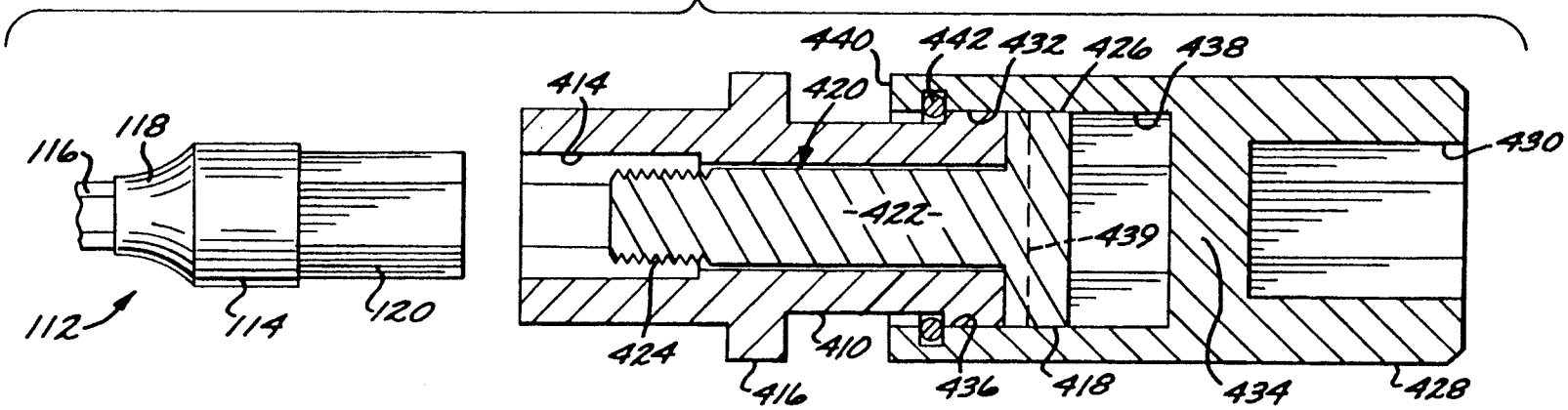
FIG. 59 is an axial section similar to FIG. 55, but showing the hex key fully in elevation and completely ejected from the assembly.

It is a quick and simple procedure to eject hex key 112 and replace it, should its forwardly projecting torquing portion 116 become damaged or broken as shown in FIGS. 55 and 59. The first step is to remove socket member 370 from the rest of the tool by manipulating quick-release sleeve 384 as described hereinabove in detail. Then, assembly 408 of hex key holder 410, hex key 112, retention shaft 420, and tubular connector 428 is simply dropped out of the open rear end of socket body 372. FIG. 50 illustrates assembly 408 being released out of the rearward end of socket body 372.

With assembly 408 removed from socket body 372, it becomes a free entity as illustrated in FIGS. 52, 55 and 59 which can easily be manipulated. First, key holder 410 and tubular connector 428 are pulled axially apart to their most extended relative positions as illustrated in FIGS. 55 and 59. This places key holder hex head 418 in the annular forward portion 436 of connector forward bore 432, thereby enabling free relative rotation between holder 410 and connector 428. Nevertheless, retention shaft hex head 426 remains engaged in the hex rearward portion 438 of bore 432 so as to rotationally lock retention shaft 420 to tubular connector 428. Then key holder 410 and connector 428 are rotated relative to each other, or either one of them being held fixed and the other rotated, to cause relative rotation between hex key 112 and retention shaft 420 for ejecting key 112, key 112 being nonrotative relative to holder 410 because of the hex engagement of the key within the forward bore portion of holder 410. Assuming key holder 410 were held stationary, the direction of rotation of connector 428, looking forwardly or from right to left in FIG. 55, would be counterclockwise to accomplish the key ejection. FIG. 59 illustrates broken hex key 112 thus completely ejected from key holder 410.

A new key 112 is inserted in the forward end of holder 410 and is reengaged with retention shaft 420 by reversing the relative rotation between holder 410 and connector 428 with holder 410 and connector 428 still in their most extended relative positions. The reassembly is completed by simply dropping assembly 408 back into socket body 372 through the rear end of body 372 so that assembly 408 slides to its forwardmost position in socket body 372, and then reconnecting socket member 370 with the rest of the tool by manipulation of quick-release sleeve 384.

Although a flush head-type Hi-Lok fastener 10 has been illustrated in the drawings, the various forms of fastener installation tools of the present invention are equally applicable to a protruding head-type Hi-Lok fastener. Also, although the various forms of Hi-Lok fastener installation tools according to the invention are specifically designed for installation of noninterference-type Hi-Lok fasteners for which the pin component must be held against rotation relative to the workpieces, it is to be understood that the present invention also functions equally as well for interference fit Hi-Lok fasteners. With interference-type Hi-Lok fasteners, the pin component is held against rotation independently of the installation tool by means of a diametrical interference fit between the pin component and the workpieces, without need for hex key 112 of the invention to hold the pin component against rotation. If there is no broached hex recess in the pin component shank, then all that is required for adaptation of the installation tools of the invention is to simply rotate the retention shaft in the key holder to eject hex key unit 112, and the installation tool will fit the interference fit Hi-Lok fastener.

While the present invention has been described in what are conceived to be the most practical and preferred embodiments, it is recognized that departures may be made therefrom within the scope of the invention, which is therefore not to be limited to the details disclosed herein, but is to be accorded the full scope of the appended claims.

I claim:

1. A tool for installing a threaded fastener of the Hi-Lok type, comprising a pin component having a headed end and a threaded end with a hex recess therein, and a collar component having a threaded body and a torque-off nut, which comprises:

body means comprising rotary motivating means;

drive head assembly means generally fixedly supported on said body means and having rotary power receiving means therein operatively connected to said motivating means for rotation of said receiving means;

tubular socket means having forward and rearward portions and having a cylindrical through bore, said rearward portion being rotatably supported by said drive head means and operatively connected to said power receiving means for rotation of said socket means during a fastener installation event, and said forward portion having a forwardly opening hex drive socket recess therein that is operatively engageable with said torque-off nut;

hex key means having a rearward body coaxial of said socket means bore and a forward hex wrenching shaft extending forwardly of said socket means, said wrenching shaft being receivable in said pin component hex recess for holding said pin component against rotation during a fastener installation event, said key body having a rearward external hex surface and a rearwardly opening threaded bore;

tubular key holder means coaxial with but rotationally independent of said socket means, at least a forward portion of said holder means being located within said socket means bore, said holder means having a forwardly opening internal hex engageable over said key body hex to rotationally lock said key means and said holder means together;

retention means extending coaxially through said holder means but rotationally independent of said holder means, said retention means having an externally threaded forward end portion that is threadedly engageable in said threaded bore of said key means, and having limit means thereon which is interengageable with said holder means to limit forward location of said retention means in said holder means;

said retention means being biased forwardly toward a forwardmost position of repose in said socket means, and said retention means and key means being rearwardly retractable relative to said socket means against the biasing force of said spring means during a fastener installation event as said socket means moves forwardly relative to said key means; and antirotation means connected to said drive head assembly means and operatively associated with said holder means for holding said holder means fixed against rotation relative to said assembly means;

said key means being forwardly threadedly removable from said holder means by rotating said retention means in one direction relative to said holder means, and another said key means being threadedly replaceable in said holder means by rotating said retention means in the other direction relative to said holder means.

2. A tool as defined in claim 1, wherein said retention means comprises spring means operatively associated with said retention means to bias said retention means forwardly toward a forwardmost position of repose in said socket means, said retention means and key means being rearwardly retractable relative to said socket means against the biasing force of said spring means during a fastener installation event as said socket means moves forwardly relative to said key means.

3. A tool as defined in claim 2, wherein said spring means comprises wire spring means mounted on said drive head assembly means and operatively engaged with said holder means.

4. A tool as defined in claim 3, which comprises slot means in said holder means, and said antirotation means comprises engagement of a portion of said spring means in said slot means.

5. A tool as defined in claim 1, wherein said drive head assembly means is elongated, extending from generally proximate said body means to a free end portion remote from said body means;

said socket means and holder means being supported generally proximate said free end portion.

6. A tool as defined in claim 4, wherein said drive head assembly means is elongated, extending from generally proximate said body means to a free end portion remote from said body means;

said socket means and holder means being supported generally proximate said free end portion;

said spring means having a base end portion attached to said drive head assembly means generally toward said body means and an elongated body portion extending from said base end portion longitudinally along the length of said drive head assembly means to a free end portion that is engaged in said slot means.

7. A tool as defined in claim 1, which comprises stop means interengageable between said holder means and said socket means to limit forward travel of said holder means relative to said socket means.

8. A tool as defined in claim 7, wherein said stop means comprises head means on the rearward end of said holder means and engageable against the rearward end of said socket means.

9. A tool as defined in claim 4, which comprises head means on the rearward end of said holder means and engageable against the rearward end of said socket means to limit forward travel of said holder means relative to said socket means;

said slot means being located in said holder means head.

10. A tool as defined in claim 6, which comprises head means on the rearward end of said holder means and engageable against the rearward end of said socket means to limit forward travel of said holder means relative to said socket means;

said slot means being located in said holder means head and being oriented generally transverse to the length of said drive head assembly means;

said free end portion of said spring means comprising a transverse cross-head portion of said spring means that is engaged in said slot means.

11. A tool as defined in claim 1, which comprises head means on said retention means exposed rearwardly of said drive head assembly means for manual rotation of said retention means to remove one said key means and replace it with another said key means.

12. A tool as defined in claim 11, wherein said retention head means is peripherally knurled to facilitate manual manipulation.

13. A tool as defined in claim 2, which comprises head means on said retention means exposed rearwardly of said drive head assembly means for manual rotation of said retention means to remove one said key means and replace it with another said key means.

14. A tool as defined in claim 8, wherein said limit means on said retention means comprises head means on said retention means exposed rearwardly of said drive head assembly means for manual rotation of said retention means to remove one of said key means and replace it with another said key means;

said retention head means overlying and axially engaging said holder head means.

15. A tool as defined in claim 9, wherein said limit means on said retention means comprises head means on said retention means exposed rearwardly of said drive head assembly means for manual rotation of said retention means to remove one of said key means and replace it with another said key means;

said retention shaft head means overlying and axially engaging said holder head means.

16. A tool as defined in claim 10, wherein said limit means on said retention shaft means comprises head means on said retention shaft means exposed rearwardly of said drive head assembly means for manual rotation of said retention shaft means to remove one of said key means and replace it with another said key means;

said retention shaft head means overlying and axially engaging said holder head means.

17. A tool as defined in claim 15, wherein said retention means has annular groove means therein which axially registers with said slot means in said holder means;

said portion of said spring means that is engaged in said slot means also being engaged in said annular groove means for axially locating said retention means against rearward movement relative to said holder means.

18. A tool as defined in claim 16, wherein said retention means has annular groove means therein which axially registers with said slot means in said holder means;

said transverse cross-head portion of said spring means that is in engagement with said slot means also being engaged in said annular groove means for axially locating said retention means against rearward movement relative to said holder means.

19. A tool as defined in claim 1, which comprises a 20° ratchet head tool, and wherein said power receiving means comprises ratchet gear means.

20. A tool as defined in claim 1, which comprises a straight ratchet head tool, and wherein said power receiving means comprises ratchet gear means.

21. A tool as defined in claim 1, which comprises a flush ratchet head tool, wherein said power receiving means comprises ratchet gear means, and said socket means is embodied in said ratchet gear means.

22. A tool as defined in claim 1, which comprises a geared L-head tool, and wherein said power receiving means comprises spur gear means.

23. A tool as defined in claim 22, wherein said socket means is embodied in said spur gear means.

24. A tool as defined in claim 2, which comprises a 20° ratchet head tool, and wherein said power receiving means comprises ratchet gear means.

25. A tool as defined in claim 2, which comprises a straight ratchet head tool, and wherein said power receiving means comprises ratchet gear means.

26. A tool as defined in claim 2, which comprises a flush ratchet head tool, wherein said power receiving means comprises ratchet gear means, and said socket means is embodied in said ratchet gear means.

27. A tool as defined in claim 2, which comprises a geared L-head tool, and wherein said power receiving means comprises spur gear means.

28. A tool as defined in claim 27, wherein said socket means is embodied in said spur gear means.

29. A tool as defined in claim 2, wherein said spring means comprises leaf spring means mounted on said drive head assembly means and operatively engaged with said holder means.

30. A tool as defined in claim 29, which comprises head means on the rearward end of said holder means and engageable against the rearward end of said socket means to limit forward travel of said holder means relative to said socket means;

said head means having an oblong rearward projection thereon; and said leaf spring means having an elongated slot therein which is generally complementary to said oblong head projection, said projection fitting into said slot so as to secure said holder means against rotation relative to said drive head assembly means.

31. A tool as defined in claim 30, wherein said head projection and leaf spring slot each have opposed, substantially parallel, straight, elongated side edges, such side edges on said head projection being generally aligned with said side edges on said leaf spring slot.

32. A tool as defined in claim 30, wherein there is an increasing gap between said head projection and the edges of said elongated slot from the longitudinal center of said head projection toward its ends to allow some play between said holder means and said drive head assembly means, whereby to rotationally cushion said key means relative to said fastener pin component, and to facilitate rotational alignment of said key means with said hex recess in said pin means.

33. A tool as defined in claim 1, which comprises a manual installation tool.

34. A tool as defined in claim 2, which comprises a manual installation tool.

35. A tool as defined in claim 34, wherein said body means comprises a pair of elongated actuating arms terminating at overlapping drive head portions forming a portion of said drive head assembly means and pivotally connected for relative rotational oscillation;

said rotary power receiving means comprising ratchet gear means.

36. A tool as defined in claim 35, which comprises pawl means in said drive head assembly means pivotally mounted on one of said overlapping head portions and spring-biased against said ratchet gear means; and cog lever means in said drive head assembly means pivotally mounted on the other said overlapping head portion and spring-biased against said ratchet gear means.

37. A tool as defined in claim 2, which comprises a pistol grip straight drive installation tool.

38. A tool as defined in claim 37, wherein said spring means comprises helical compression spring means.

39. A tool as defined in claim 37, which comprises stop means interengageable between said holder means and said socket means to limit forward travel of said holder means relative to said socket means.

40. A tool as defined in claim 37, wherein said key holder means and retention means have overlapping hex heads on their rearward ends;

connector means within said tubular socket means, said connector means having a forwardly opening bore within which both of said heads are received; and nonrotating shaft means extending forwardly from said drive head assembly means through a rearward portion of said socket means, a rearward end portion of said shaft means being held against rotation in said drive head assembly means, and a forward end portion of said shaft means being engageable with said connector means to hold said connector means against rotation;

a rearward portion of said connector means bore having a first bore portion with a hex cross-section, and a forward portion of said connector means bore having a second bore portion with a round cross-section;

said connector means and holder means being in an axially collapsed condition with said hex heads both being located in said hex first bore portion during a fastener installation event so that said connector means holds said holder means and key means against rotation; and said connector means and holder means being axially extensible to an extended condition for threaded ejection of the key means from the holder means, in which condition said retention shaft means hex head remains in said first bore portion, but said holder means hex head registers with said second bore portion so that said holder means is freely rotatable relative to said connector means, whereby said key means is forwardly threadedly removable from said holder means by relative rotation between said connector means and said holder means in one direction, and another said key means is threadedly replaceable in said holder means by relative rotation between said connector means and said holder means in the other direction.

41. A tool as defined in claim 40, which comprises axial stop means interengageable between said connector means and said holder means to limit the extent of said extended condition and retain said connector means, holder means, retention means, and key means together as an assembly.

42. A tool as defined in claim 41, which comprises quick-release means on the rear end portion of said socket means enabling quick disengagement of said socket means from said drive head assembly means and quick reengagement of said socket means with said drive head assembly means;

said quick-release means enabling said assembly to be quickly removable from said socket means through its rear end for convenience in manipulation of said connector means and holder means for threadedly removing and replacing a said key means from said holder means, and then quickly replaceable within said socket means.

* * * * *